US010501980B2

(12) United States Patent
Norwood

(10) Patent No.: US 10,501,980 B2
(45) **Date of Patent: *Dec. 10, 2019**

(54) THREE-DIMENSIONAL PREFABRICATED FLASHING SCAFFOLDING SYSTEM

(71) Applicant: Norwood Architecture, Inc., Louisville, CO (US)

(72) Inventor: Steven A. Norwood, Louisville, CO (US)

(73) Assignee: Norwood Architecture, Inc., Louisville, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/214,416

(22) Filed: Dec. 10, 2018

(65) Prior Publication Data

US 2019/0112864 A1 Apr. 18, 2019

Related U.S. Application Data

(63) Continuation of application No. 14/941,335, filed on Nov. 13, 2015, now Pat. No. 10,161,179.

(51) Int. Cl.

| | |
|---|---|
| ***E06B 1/62*** | (2006.01) |
| ***E06B 7/14*** | (2006.01) |
| ***E06B 1/36*** | (2006.01) |

(52) U.S. Cl.

CPC ..... *E06B 1/62* (2013.01); *E06B 1/36* (2013.01); *E06B 7/14* (2013.01); *E06B 2001/628* (2013.01)

(58) Field of Classification Search

CPC ..... E06B 1/62; E06B 1/36; E06B 7/14; E06B 2001/628

(Continued)

(56) References Cited

U.S. PATENT DOCUMENTS

| | | |
|---|---|---|
| RE24,027 E | 6/1955 | Bourne et al. |
| 2,822,763 A | 2/1958 | Berg |

(Continued)

FOREIGN PATENT DOCUMENTS

| | | |
|---|---|---|
| CA | 2292301 | 1/2001 |
| WO | 2004055293 A1 | 7/2004 |

OTHER PUBLICATIONS

Dryvit AquaFlash System Installation Guide DS196, retrieved from http://www.dryvit.com/residential/products_list.asp?type=4, dated Mar. 3, 2009, 5 pages.

(Continued)

*Primary Examiner* — Parick J Maestri
*Assistant Examiner* — Joseph J. Sadlon
(74) *Attorney, Agent, or Firm* — Lathrop Gage LLP

(57) ABSTRACT

A three dimensional scaffold formed of mesh, or semi-porous material is designed to be inserted into and to surround an opening in the exterior structure of a building to receive a fenestration product such as a door, a vent, a window and a skylight. The three dimensional scaffold is pre-formed into three-dimensional shapes that include corners, returns, back-dams, and optional head flaps that provide a scaffold and backing for the application of a fluid applied water/weather-proofing material. The separate fluid applied waterproofing/weatherproofing may be applied by spray, brush or roll and can be asphalt, rubber, plastic or other fluid applied material. The scaffolding may be formed out of mesh, or other semi-porous fiberglass, metal, plastic, synthetic or other material that can be formed into three dimensional shapes. When combined with a fluid applied weather/waterproofing, the scaffolding provides a superior, continuous, reinforced weather/water-proofing system to protect openings and fenestrations in buildings.

17 Claims, 22 Drawing Sheets

(58) Field of Classification Search
USPC ..... 52/204.5, 209
See application file for complete search history.

(56) References Cited

U.S. PATENT DOCUMENTS

| | | | | |
|---|---|---|---|---|
| 2,974,448 | A | 3/1961 | Weis | |
| 3,416,271 | A | 12/1968 | Heeney | |
| 4,543,753 | A | 10/1985 | Sonneborn et al. | |
| 4,621,466 | A | 11/1986 | Sonneborn et al. | |
| 4,694,612 | A | 9/1987 | Pruden et al. | |
| 4,873,803 | A | 10/1989 | Rundo | |
| 4,972,638 | A | 11/1990 | Minter | |
| 5,018,333 | A | 5/1991 | Bruhm | |
| 5,065,553 | A | 11/1991 | Magid | |
| 5,544,463 | A * | 8/1996 | Bergin | E04F 13/06 52/254 |
| 5,586,415 | A | 12/1996 | Fisher et al. | |
| 5,778,617 | A * | 7/1998 | Free | E04F 13/06 411/466 |
| 5,899,026 | A | 5/1999 | Williams et al. | |
| 5,946,870 | A | 9/1999 | Bifano et al. | |
| 6,023,892 | A * | 2/2000 | Sourlis | E04B 1/644 210/170.01 |
| 6,162,525 | A * | 12/2000 | Amy | E04F 21/02 156/71 |
| 6,189,273 | B1 * | 2/2001 | Larson | E04F 13/06 52/255 |
| 6,212,834 | B1 | 4/2001 | Lindgren | |
| 6,293,064 | B1 | 9/2001 | Larson | |
| 6,305,130 | B1 | 10/2001 | Ackerman, Jr. | |
| D457,658 | S * | 5/2002 | Harel | E04F 13/06 D25/121 |
| 6,385,925 | B1 | 5/2002 | Wark | |
| 6,401,401 | B1 | 6/2002 | Williams | |
| 6,401,402 | B1 * | 6/2002 | Williams | E06B 1/62 49/471 |
| 6,457,279 | B1 | 10/2002 | Jacobsen et al. | |
| 6,526,709 | B1 | 3/2003 | Jacobsen | |
| 6,640,508 | B2 | 11/2003 | Lindgren et al. | |
| 6,725,610 | B2 | 4/2004 | Murphy et al. | |
| 7,222,462 | B2 | 5/2007 | Ellingson | |
| 7,296,387 | B2 * | 11/2007 | Milu | E04F 19/02 52/287.1 |
| 7,331,145 | B2 | 2/2008 | Feucht et al. | |
| 7,591,106 | B2 | 9/2009 | Conlin | |
| 7,673,426 | B2 | 3/2010 | Broad et al. | |
| 7,676,996 | B2 | 3/2010 | Teodorovich | |
| 7,775,004 | B2 | 8/2010 | Allen | |
| 7,797,884 | B2 | 9/2010 | Allen | |
| 7,874,121 | B1 | 1/2011 | Hohmann, Jr. | |
| 7,877,940 | B2 | 2/2011 | Meeks et al. | |
| 7,877,945 | B2 | 2/2011 | Eggen et al. | |
| 7,937,900 | B1 | 5/2011 | Gaffney et al. | |
| 8,006,445 | B2 | 8/2011 | Burton et al. | |
| 8,065,839 | B2 | 11/2011 | Conlin | |
| 8,372,226 | B2 * | 2/2013 | Gumm | H01L 31/048 136/244 |
| 8,387,336 | B2 | 3/2013 | Coulton et al. | |
| 8,561,357 | B2 | 10/2013 | Teodorovich | |
| 8,661,741 | B2 * | 3/2014 | Hohmann, Jr. | E02D 31/02 428/349 |
| 8,683,695 | B2 | 4/2014 | Rasmussen et al. | |
| 8,959,842 | B2 | 2/2015 | Norwood et al. | |
| 2002/0108326 | A1 | 8/2002 | Ackerman, Jr. | |
| 2003/0056444 | A1 | 3/2003 | Ackerman, Jr. | |
| 2003/0177712 | A1 | 9/2003 | Gatherum | |
| 2004/0163330 | A1 | 8/2004 | Crum | |
| 2005/0144865 | A1 | 7/2005 | Elingson | |
| 2005/0166471 | A1 | 8/2005 | Allen | |
| 2006/0010788 | A1 | 1/2006 | Nettleton | |
| 2006/0130426 | A1 | 6/2006 | O'Rourke et al. | |
| 2006/0236618 | A1 | 10/2006 | Williams | |
| 2006/0260216 | A1 | 11/2006 | Bonshor | |
| 2008/0178557 | A1 | 7/2008 | Parsons et al. | |
| 2008/0229676 | A1 | 9/2008 | Allen | |
| 2009/0056241 | A1 | 3/2009 | Koessler et al. | |
| 2010/0139178 | A1 | 6/2010 | Ehrman et al. | |
| 2010/0251643 | A1 | 10/2010 | Rosende et al. | |
| 2011/0047888 | A1 | 3/2011 | Bonshor | |
| 2011/0072747 | A1 | 3/2011 | Tatley et al. | |
| 2012/0144761 | A1 | 6/2012 | Teodorovich | |
| 2017/0022750 | A1 * | 1/2017 | Helton | E06B 7/16 |
| 2017/0051553 | A1 * | 2/2017 | Murphy | E06B 1/70 |

OTHER PUBLICATIONS

Dryvit Backstop NT and AquaFlash DS268, retrieved from http://www.dryvit.com/residential/products_list.asp?type=4, dated 2014, 4 pages.

Dryvit Flashing Tape, Flashing Tape Surface Conditioner and Grid Tape DS450, retrieved from http://www.dryvit.com/residential/products_list.asp?type=4 on, dated Apr. 30, 2015, 3 pages.

Dryvit AquaFlash System DSC494, retrieved from http://www.dryvit.com/residential/products_list.asp?type=4, dated 2008, 2 pages.

Dryvit Safety Data Sheet SDS1294, retrieved from http://www.dryvit.com/residential/products_list.asp?type=4, dated May 22, 2015, 3 pages.

Dryvit AquaFlash and Backstop NT, AF BS NT, retrieved from http://www.dryvit.com/residential/products_list.asp?type=4, dated 2010, 2 pages.

Quickflash Weatherproofing Products, Home Constructions Equipment, Toxic Mold Prevention; Retrieved from http://www.quickflashproducts.com/products_eletrical.html on Jun. 20, 2012, 15 pages.

U.S. Appl. No. 29/429,452.

U.S. Appl. No. 29/429,452 Notice of Allowance dated May 27, 2014, 8 pages.

U.S. Appl. No. 13/572,274 Office Action dated Sep. 18, 2014, 8 pages.

U.S. Appl. No. 13/572,274 Response dated Oct. 20, 2014, 13 pages.

U.S. Appl. No. 13/572,274 Notice of Allowance dated Oct. 29, 2014, 5 pages.

U.S. Appl. No. 13/572,274 Select File History dated Aug. 10, 2012 through Oct. 29, 2014, 82 pages.

U.S. Appl. No. 14/228,590 Office Action dated Jan. 12, 2015, 26 pages.

U.S. Appl. No. 14/628,714 Non-final Office Action dated Apr. 30, 2015, 10 pages.

U.S. Appl. No. 14/228,590 Notice of Allowance dated Jul. 20, 2015, 7 pages.

U.S. Appl. No. 29/501,163, Notice of Allowance dated Sep. 15, 2015, 28 pages.

U.S. Appl. No. 14/628,714 Final Rejection dated Nov. 17, 2015, 9 pages.

Mexican Patent Application MXa2013009322 Office Action dated Jul. 3, 2015, 2 pages.

U.S. Appl. No. 14/479,282 Non-final Office Action dated Jul. 16, 2015, 11 pages.

U.S. Appl. No. 14/479,282 Final Office Action dated Feb. 1, 2016, 11 pages.

Chinese Patent Application 201310347255.0 Office Action dated Apr. 29, 2015, 14 pages.

Chinese Patent Application 201310347255.0 Office Action dated Jan. 4, 2016, 11 pages.

International Search Report and Written Opinion dated May 11, 2017, for International Patent Application No. PCT/US2016/061818, 12 pages.

* cited by examiner

THREE-DIMENSIONAL PREFABRICATED FLASHING SCAFFOLDING SYSTEM

RELATED APPLICATIONS

This application is a continuation of U.S. patent application Ser. No. 14/941,335, which is incorporated by reference in its entirety herewith.

BACKGROUND

Building construction commonly involves flashing and sealing of openings in the exterior surface of a structure, where fenestration products such as windows, doors, skylights, and vents are located, to prevent moisture or air from entering the envelope of the structure. To water/weather-proof such openings, various types of flashing products have been developed which are installed at the openings and surrounding the fenestration products. One such flashing product includes strips of self-adhered flashing often sold in rolls and made of asphalt, rubber or similar materials. These strips of self-adhered flashing are commonly adhered to the sheathing and wrapped into the opening at the framing surface of the opening, or adhered to the sheathing and placed over the edges, "fins," or frames of the fenestration product. The opening in the exterior of the structure is typically described as having a bottom edge (the sill), a top edge (the head), and the vertical side edges (the jambs). The self-adhered flashing products have significant disadvantages. These flashings come in rolls of material, typically field cut into strips. The flashing strips do not form a continuous membrane surface, as they rely on adhesion and proper lapping to prevent water and air intrusion at the joints between the flashing strips and to prevent gaps and openings at the corners of the fenestration products and the openings. In particular, openings have historically suffered from leaks due to defects in the installation of the flashing as well as the inherent difficulty of water/weather-proofing the three dimensional corners of openings with flat or folded strips of flashing. The flashing strips are flat and are not manufactured to a three dimensional shape. The flashing can be folded into an opening, but inherent waterproofing problems result where the flat or folded strips meet the corners of the opening. In addition, due to the flat nature of the flashing products, the flashing material itself does not form returns, or back dams to reduce the infiltration of water and/or air at the opening.

Another flashing application for openings includes the use of spray, roll, or brush applied water/weather-proofing products that coat the opening in an attempt to provide complete water/weather-proofing of openings without seams or joints. These fluid applied flashing systems also have significant disadvantages including the propensity of the fluid applied flashing to crack at the corners of the opening as the material dries or is stressed due to thermal movement of the building and openings. To reduce this cracking or breaches in the fluid applied flashing, some products also recommend the use of a separate flat reinforcing mesh tape, typically made of fiberglass, to reinforce the membrane. The mesh tape, like the above described flashing strips, comes in rolls and thus does not form a three dimensional shape to reinforce the corner or to provide a backing for flashing returns, or back-dams. In addition, these fluid applied systems do not include, within the flashing material itself, returns, or back-dams to reduce the infiltration of water and/or air at the opening. The likelihood of moisture and air intrusion at openings is greater in openings that do not include back dams to limit the passage of air or water and to re-direct water back to the exterior.

SUMMARY OF THE INVENTION

In one embodiment, a three-dimensional prefabricated scaffolding for use in flashing a fenestration opening of a structure is disclosed. The three-dimensional prefabricated scaffold includes a flange and a return connected to the flange. The flange and return are formed of a mesh, semi-porous or solid material, and have a sufficient rigidity to maintain a three-dimensional shape.

In certain embodiments, the three-dimensional prefabricated flashing may have an adhesive attached to a rear, interior facing surface such that the scaffolding may adhere to an opening in a structure for a fenestration product.

In certain embodiments, the return defines a first plane, and the flange defines a second plane that is substantially orthogonal to the first plane.

In certain embodiments, the three-dimensional prefabricated scaffolding includes a back-dam connected to the return and formed from the mesh or semi-porous material. Further, the return may define a first plane, the flange may define a second plane that is substantially orthogonal to the first plane, and the back-dam may define a third plane that is substantially parallel and offset from the second plane.

In certain embodiments, the return includes drainage ribs raised from an outer surface of the return.

In certain embodiments, the three-dimensional prefabricated scaffolding includes a drip margin between the flange and the return.

In certain embodiments, the return includes a sill/head return, for attaching to a sill/head of the opening, and a jamb return, for attaching to a jamb of the opening, and the flange connects to both the sill/head return and the jamb return. Further, the sill return may include drainage ribs raised from an outer surface of the sill return. Further, the sill/head return and jamb return may define respective first and second planes that are substantially orthogonal to each other, and the flange may define a third plane that is substantially orthogonal to both the first and second planes. Further yet, in one or more of these certain embodiments, the three-dimensional prefabricated scaffolding may include a sill/head back-dam connected to the sill/head return, and a jamb back-dam connected to the jamb return. The sill return may include drainage ribs raised from an outer surface of the sill return. It may be such that the sill/head return and jamb return define respective first and second planes that are substantially orthogonal to each other, the flange defines a third plane that is substantially orthogonal to both the first and second planes, and the sill back-dam and the jamb back-dam define a fourth plane that is substantially parallel and offset from the third plane.

In certain embodiments, the three-dimensional prefabricated scaffolding includes a hinged flap connected to the flange at an edge of the flange that is distal from the return. The hinged flap may have a greater length than the flange.

BRIEF DESCRIPTION OF THE FIGURES

The foregoing and other features and advantages of the disclosure will be apparent from the more particular description of the embodiments, as illustrated in the accompanying drawings, in which like reference characters refer to the same parts throughout the different figures. The drawings are not necessarily to scale, emphasis instead being placed upon illustrating the principles of the disclosure.

DETAILED DESCRIPTION OF THE EMBODIMENTS

Figure 1:
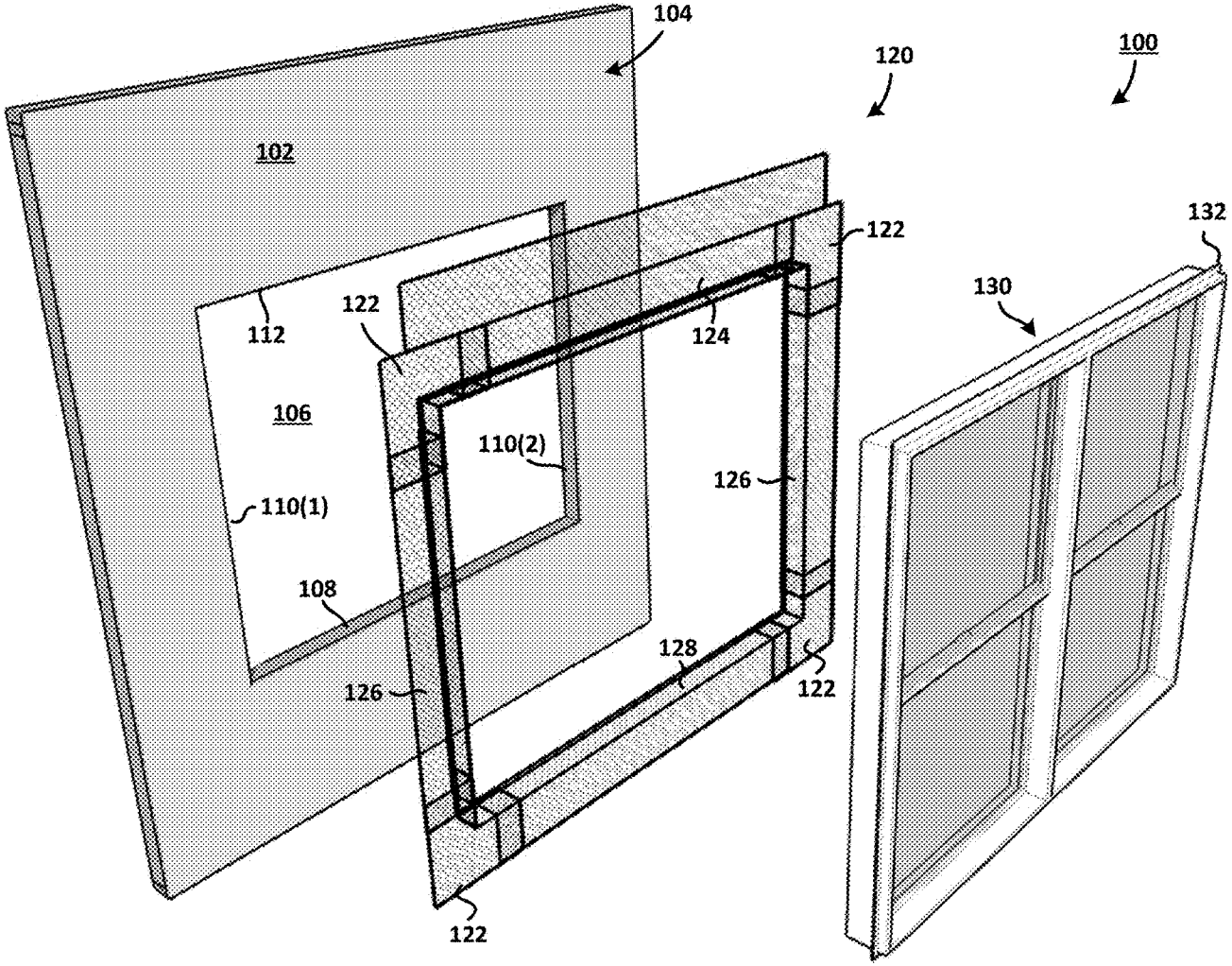
FIG. 1 depicts an exploded view of a three-dimensional prefabricated flashing scaffolding system for use during construction of buildings.

The present disclosure may be understood by reference to the following detailed description taken in conjunction with the drawings briefly described below. It is noted that, for purposes of illustrative clarity, certain elements in the drawings may not be drawn to scale. In particular, the thicknesses of many elements shown in certain drawings herein may be exaggerated in comparison to their height and width. Specific instances of an item may be referred to by use of a numeral in parentheses (e.g., jamb 110(1), 110(2), etc.) while numerals without parentheses refer to any such item (e.g., sill 108).

Fenestration is an architectural term of art that generally refers to an opening in a surface of a structure. A "fenestration product" as utilized herein is a product that extends through an exterior surface of a structure at a fenestration opening; framed windows, framed doors and skylights are examples of fenestration products.

Disclosed herein is a three-dimensional prefabricated scaffolding system and method of manufacturing and installing the same. The three-dimensional prefabricated scaffolding provides significant advantages over prior flashing products. Such advantages include, but are not limited to the following. The three dimensional elements are capable of being used with a fluid applied flashing product, thereby eliminating seams and corner failures in the flashing that are failure points for prior flashing systems, while maintaining three-dimensional features that prevent ingress of water/weather into the opening. The system and methods herein provide quick installation of the three-dimensional prefabricated scaffolding that is applicable to any size and shape of opening and fenestration product.

FIG. 1 depicts an exploded view 100 of a three-dimensional prefabricated flashing scaffolding system 120 for use during construction of buildings. Exploded view 100 illustrates a structure 102 having an exterior surface 104 with a fenestration opening 106 therein. Fenestration opening 106 is defined typically by framing including sill 108, two vertical jambs 110(1), 110(2), and head 112. Exterior surface 104 may be defined by sheathing or other material. It should be appreciated that fenestration opening 106 may be of a different shape than illustrated, such as circular, and also may not include features shown. For example, if fenestration opening 106 is for a door, there may not be a sill 108 at the bottom of the opening. Three-dimensional prefabricated flashing scaffolding system 120 includes corner pieces 122, a header piece 124, jamb pieces 126, and a sill piece 128. Features of scaffolding system 120 are discussed in further detail below. Scaffolding system 120 is installed between surface 104, header 112, jambs 110, and sill 108 of structure 102, and a fenestration product 130. While fenestration product 130 is illustrated as being a window product, it should be appreciated that fenestration product 130 may be a different product such as a door, vent, skylight, or other product installed into structure 102.

Figure 2:
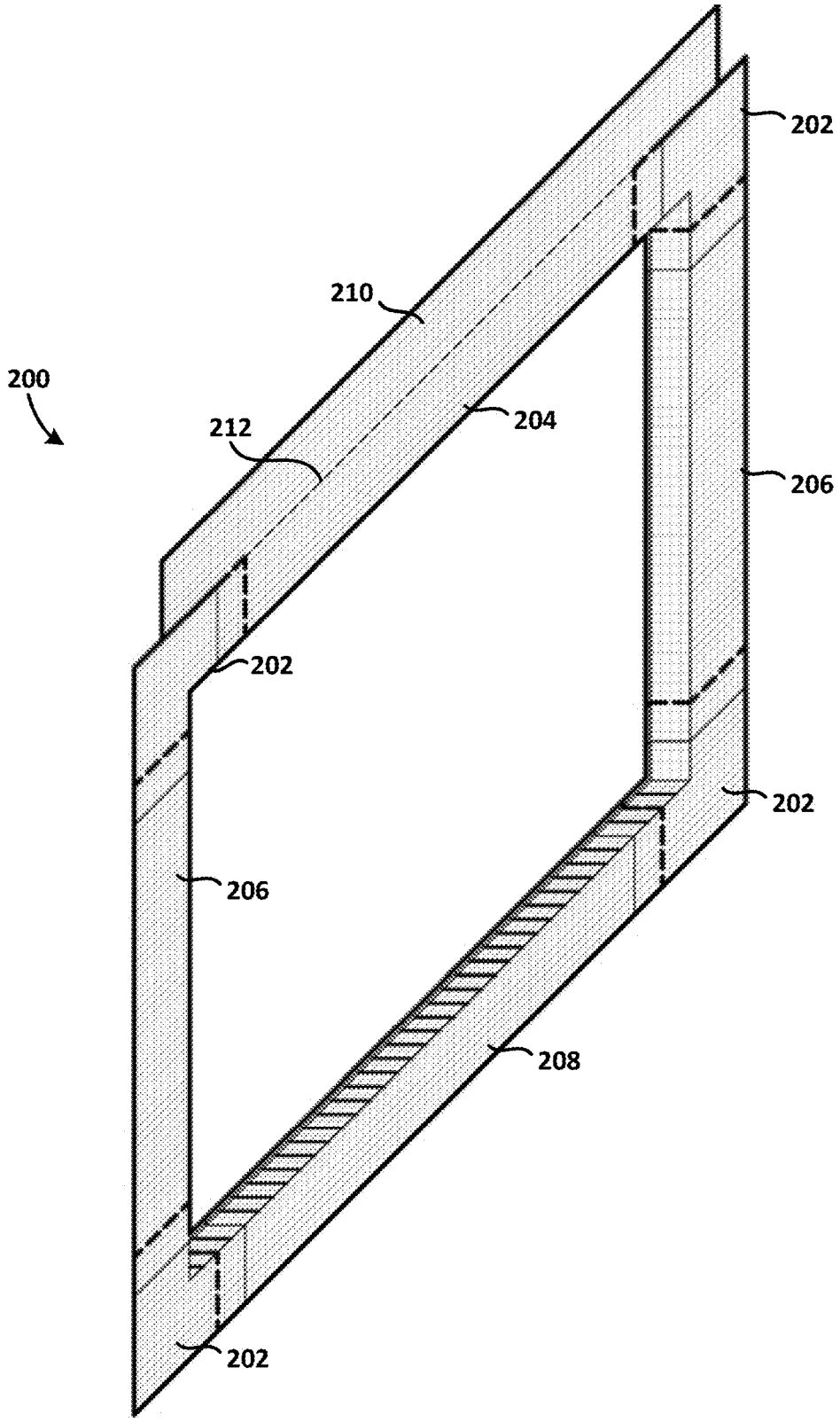
FIG. 2 illustrates an isolated three-dimensional prefabricated flashing scaffolding system.
Figure 3:
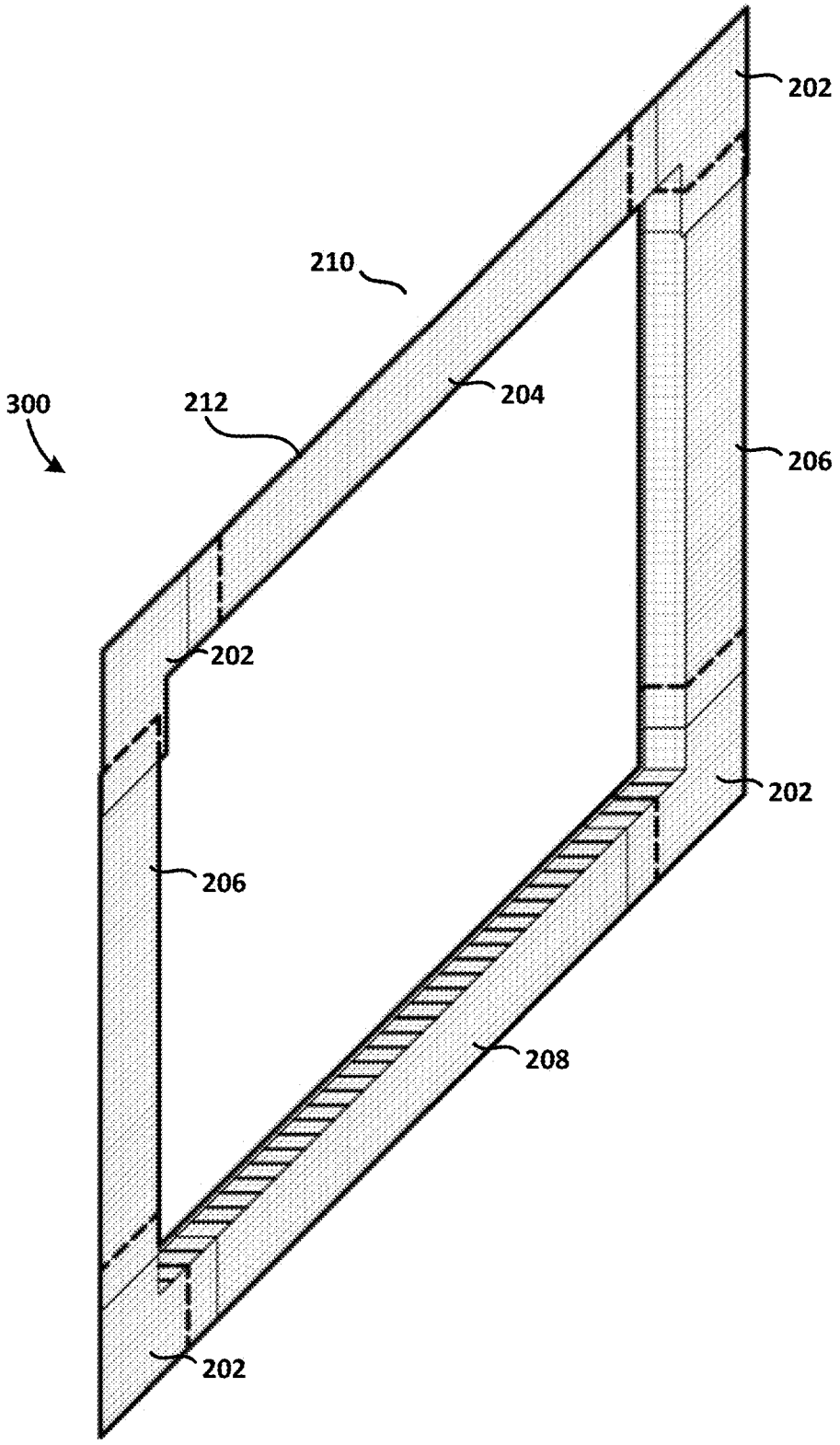
FIG. 3 illustrates an embodiment of the scaffolding system of FIG. 2 without a hinged flap.

FIG. 2 illustrates an isolated three-dimensional prefabricated flashing scaffolding system 200. Scaffolding system 200 is an embodiment of scaffolding system 120 of FIG. 1. Scaffolding system 200 includes four corner pieces 202, a header piece 204, two jamb pieces 206, and a sill piece 208. Header piece 204 is illustrated having a hinged flap 210 at the top edge 212 of header piece 204. It should be appreciated that hinged flap 210 is optional as shown in embodiment 300, of FIG. 3, which illustrates an embodiment of scaffolding system 200 without hinged flap 210. Each piece of scaffolding system 200 is formed of a material chosen from the group of materials including: fiberglass, plastic, rubber, metal, synthetics, or other formable material. While illustrated as a mesh, the scaffolding may alternatively be formed of semi-porous materials. Particularly, the mesh or semi-porous materials having a textured surface provide a surface for use with the fluid water/weather-proofing product in that the fluid permeates the surface and adequately affixes to the scaffolding. Thus, while the scaffolding itself is not water/weather-proof, once the fluid product is applied, scaffolding system 200 and the fluid material cooperate to form a water/weather-proof barrier. While each piece is formed from mesh, or semi-porous materials, each piece also has a sufficient rigidity to maintain the three-dimensional shape desired. Therefore, each piece of scaffolding system 200 may be installed, and then the fluid water/weather-proofing product may be applied (via spraying, rolling, or brushing) thereon to form the water-proof and/or weather-proof barrier.

Figure 4:
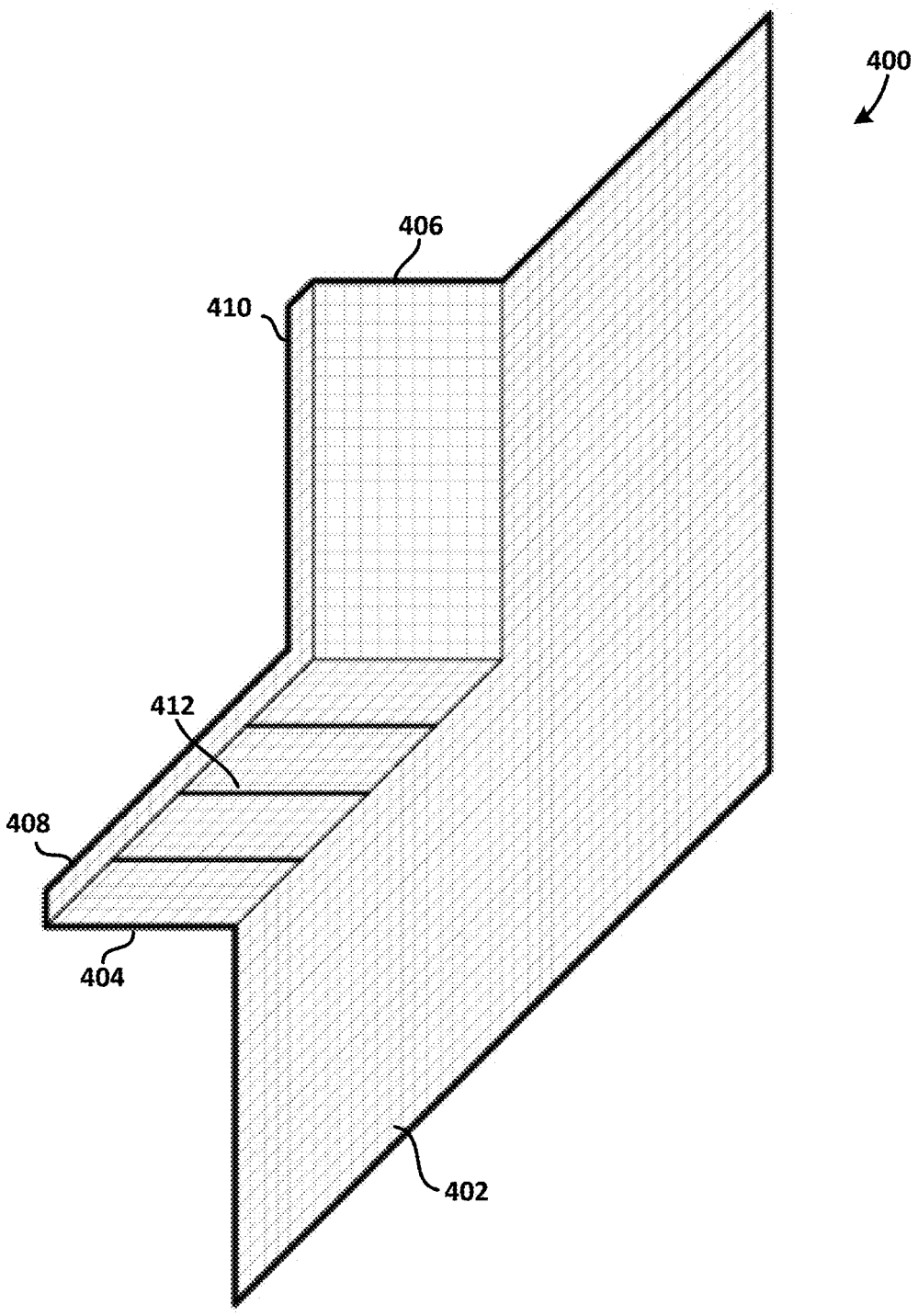
FIG. 4 illustrates an exemplary sill corner piece, in one embodiment.

FIG. 4 illustrates an exemplary sill corner piece 400, in one embodiment. Corner piece 400 is an example of corner piece 202 of FIG. 2. Particularly, referring to FIG. 1, corner piece 400 is adapted for installation at the lower right corner of opening 106, at the junction of the right vertical jamb 110(2) and sill 108. Corner piece 400 includes flange 402, sill return 404, jamb return 406, sill back-dam 408, and jamb back-dam 410. It should be appreciated that sill back-dam 408 and jamb back-dam 410 are optional. Sill return 404 and jamb return 406 are orthogonal (a) to each other, and (b) to flange 402. Optional sill back-dam 408 and jamb back-dam 410 are orthogonal to (a) each other and (b) sill return 404 and jamb return 406, respectively. Sill back-dam 408 and jamb back-dam 410 thereby lie in a plane that is substantially parallel to the plane of flange 402. Corner piece 400 further includes optional sill drainage ribs 412. Drainage ribs 412 are raised from the surface of sill return 404 such that when the fenestration product is installed, the product is offset from the surface of sill return 404 to allow for moisture drainage away from sill back-dam 408. The rear surfaces of corner piece 400 may include an adhesive such that corner piece 400 may be adhered in place to the exterior surface of structure 102 and/or the jamb 110 and sill 108. Features of sill corner piece 400 may be mirrored for installation to the lower left corner of the fenestration opening.

Figure 5:
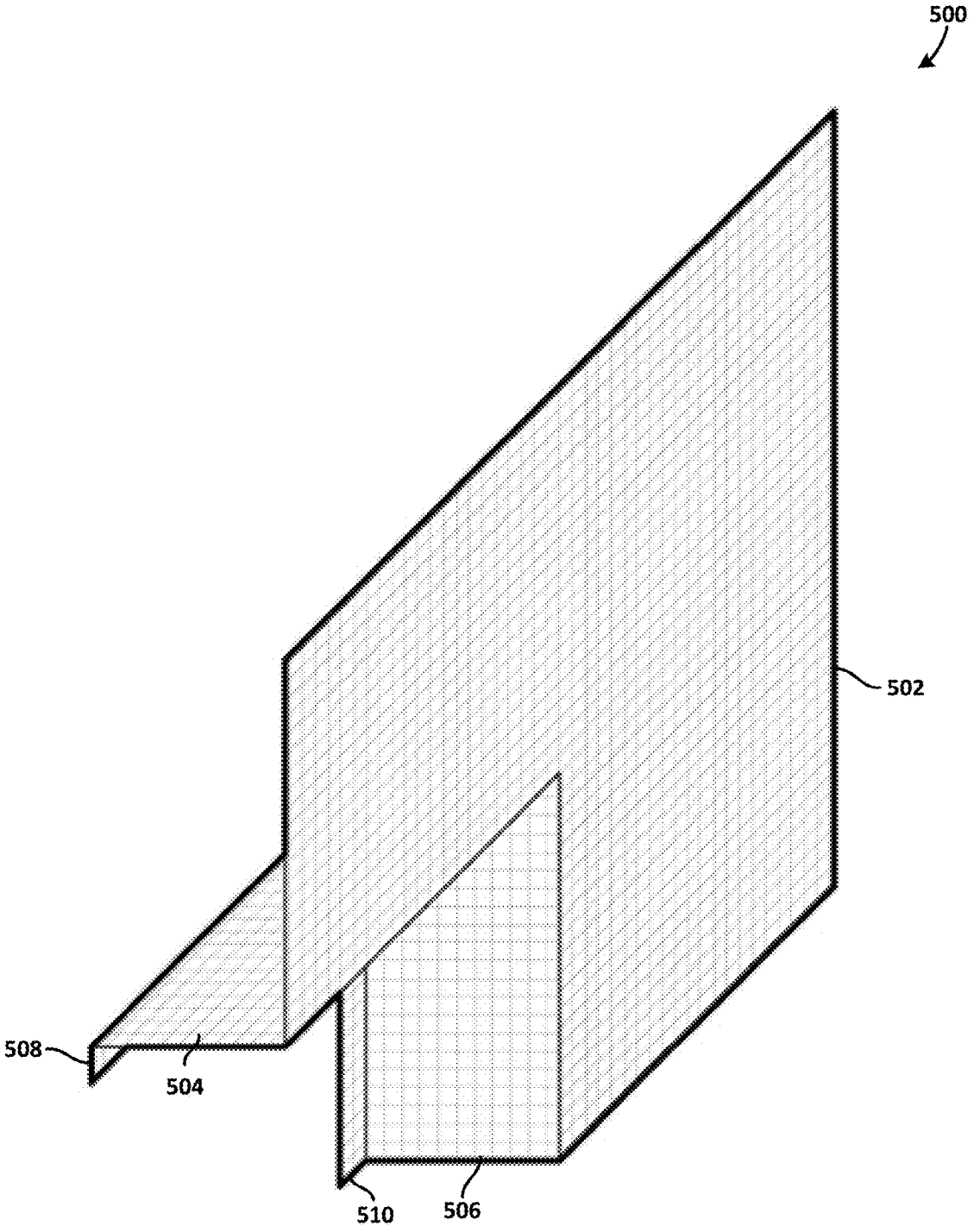
FIG. 5 illustrates an exemplary head corner piece, in one embodiment.

FIG. 5 illustrates an exemplary head corner piece 500, in one embodiment. Corner piece 500 is an example of corner piece 202 of FIG. 2. Particularly, referring to FIG. 1, corner piece 500 is adapted for installation at the upper right corner of opening 106, at the junction of the right vertical jamb 110(2) and header 104. Head corner piece 500 includes flange 502, head return 504, jamb return 506, optional head back-dam 508, and optional jamb back-dam 510. Flange 502, jamb return 506, and jamb back-dam 510 are similar to flange 402, jamb return 406, and jamb back-dam 410, respectively, as discussed above with respect to FIG. 4. Head return 504 and head back-dam 508 are similar to sill return 404 and sill back-dam 410, respectively, as discussed above with respect to FIG. 4; however, head return 504 and head back-dam 508 are adapted for installation at the head of the fenestration opening. The rear surfaces of corner piece 500 may include an adhesive such that corner piece 500 may be adhered in place to the exterior surface of structure 102 and/or the jamb 110 and head 112. Features of head corner piece 500 may be mirrored for installation to the upper left corner of the fenestration opening.

Figure 6:
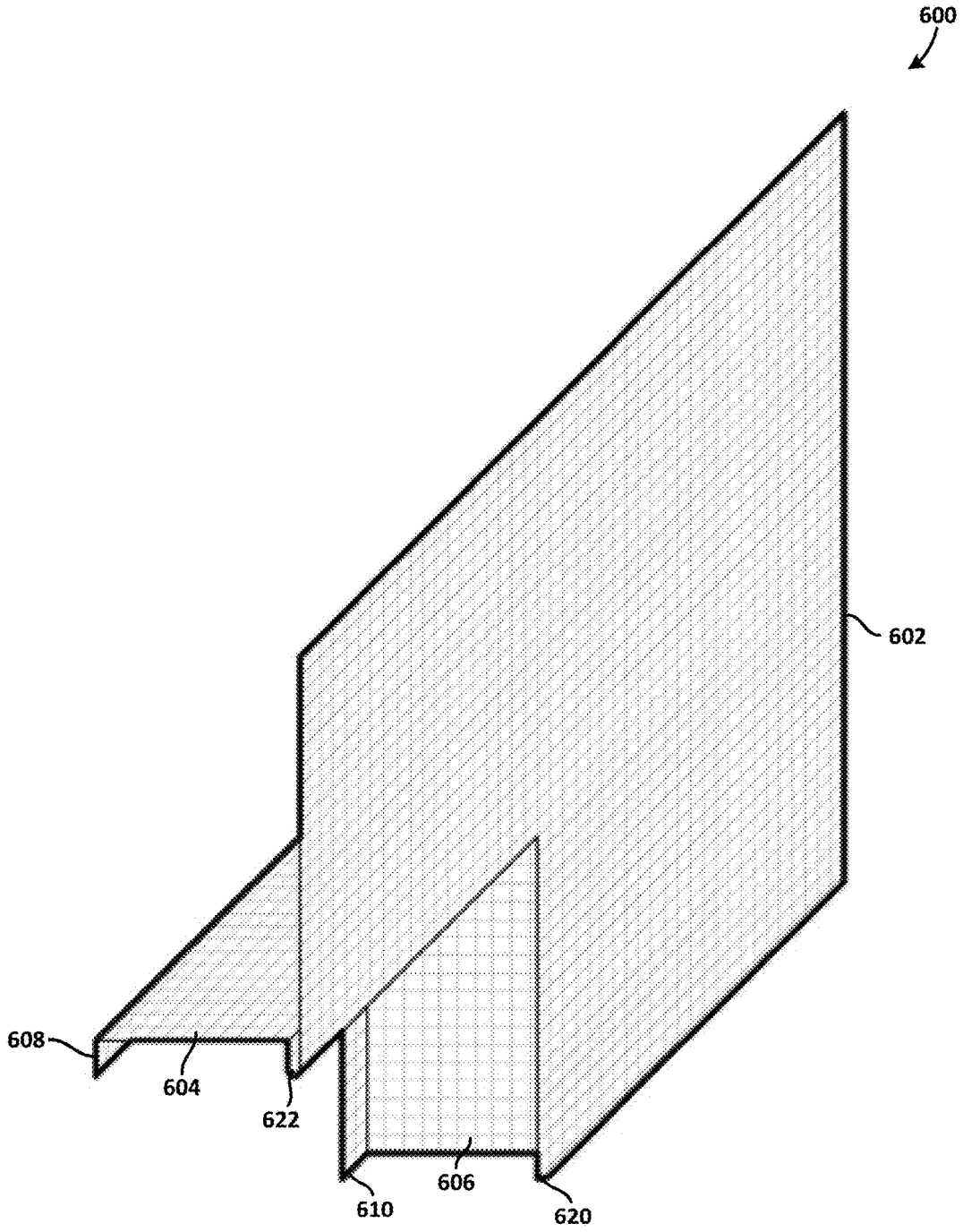
FIG. 6 illustrates an exemplary head corner piece, in another embodiment.

FIG. 6 illustrates an exemplary head corner piece 600, in another embodiment. Corner piece 600 is an example of corner piece 202 of FIG. 2. Particularly, referring to FIG. 1, corner piece 600 is adapted for installation at the upper right corner of opening 106, at the junction of the right vertical jamb 110(2) and header 104. Head corner piece 600 includes flange 602, head return 604, jamb return 606, optional head back-dam 608, and optional jamb back-dam 610. Flange 602, return 604, jamb return 606, and return back-dam 608 jamb back-dam 610 are similar to flange 502, return 504, jamb return 506, and jamb back-dam 510, respectively, as discussed above with respect to FIG. 5. Head corner piece 600 is further shown with optional jamb drip margin 620 and head drip margin 622 at the intersection of head return 604 and jamb return 606 to flange 602. The rear surfaces of corner piece 600 may include an adhesive such that corner piece 600 may be adhered in place to the exterior surface of structure 102 and/or the jamb 110 and head 112. Features of head corner piece 600 may be mirrored for installation to the upper left corner of the fenestration opening.

Figure 7:
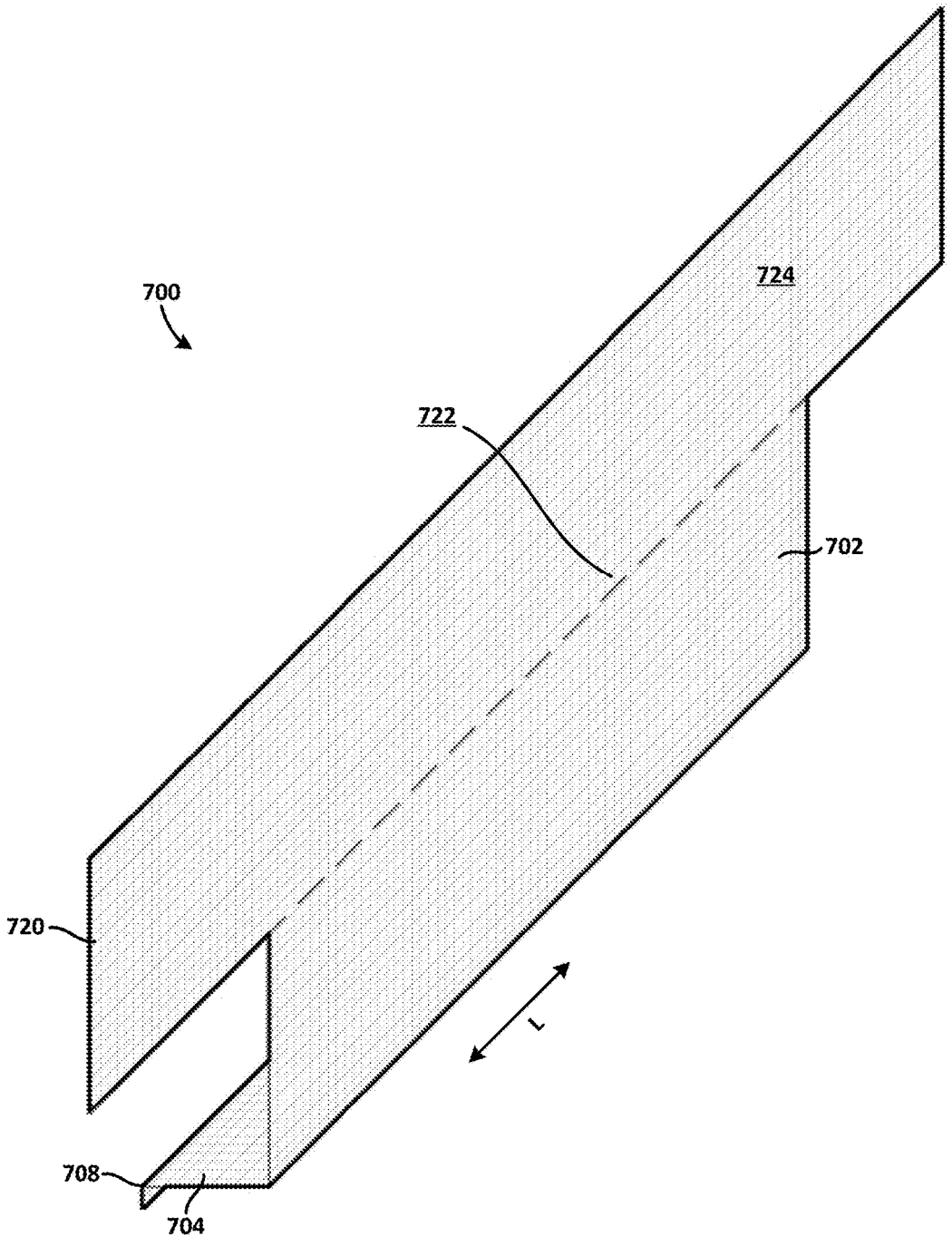
FIG. 7 illustrates an exemplary head piece, in one embodiment.

FIG. 7 illustrates an exemplary head piece 700, in one embodiment. Head piece 700 is an example of head piece 204 of FIG. 2. Particularly, referring to FIG. 1, head piece 700 is adapted for installation at the head 112. Head piece 700 includes flange 702, head return 704, and optional head back-dam 708. Flange 702, head return 704, and head back-dam 708 are similar to flange 402, return 406, and back-dam 410, respectively, as discussed above with respect to FIG. 4. For example, head return 704 is orthogonal to flange 702. Optional head back-dam 708 is orthogonal to head return 704. Head back-dam 708 is thereby in a plane that is substantially parallel to the plane of flange 702. The rear surfaces of head piece 700 may include an adhesive such that head piece 700 may be adhered in place to the exterior surface of structure 102 and/or the head 112.

Head piece 700 further includes a hinged flap 720 which is similar to hinged flap 210 of FIG. 2. Hinged flap 720 is located at the upper edge of return 702 at hinge 722. Hinged flap 720 may have a length, as defined by arrow "L" in FIG. 7 that is greater than the length of elements 702, 704, and 708 of head piece 700. Hinged flap 700 is adapted to fold, at hinge 722, and cover the nailing fin of a fenestration product—for example nailing fin 132 of the window 130 in FIG. 1. Hinge 722 may be a living hinge. Accordingly, the exterior surface 724 of hinged flap 720 may have an adhesive such that the exterior surface 724 adheres to the nailing fin when installed.

Figure 8:
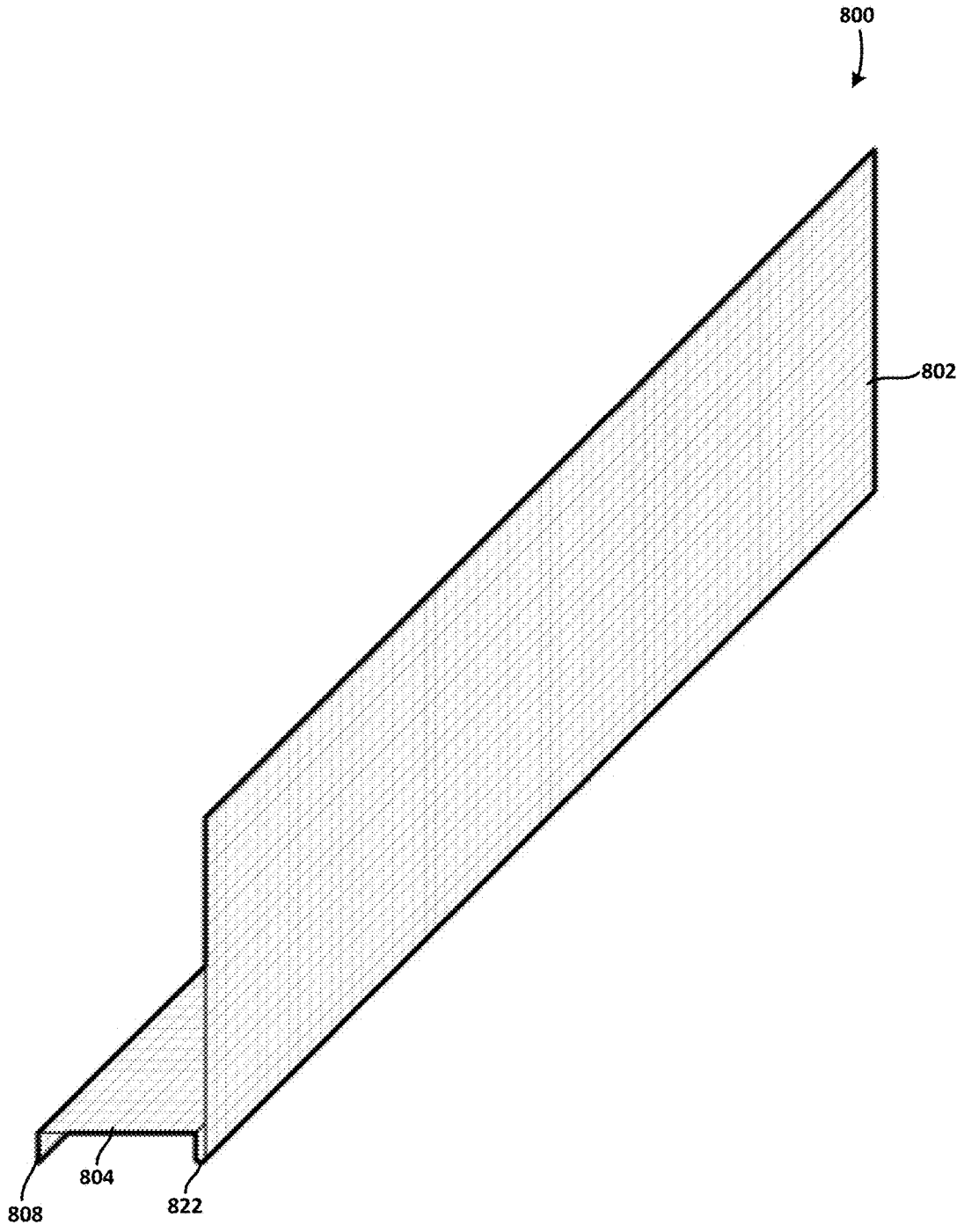
FIG. 8 illustrates an exemplary head piece, in another embodiment without a hinged flap.

FIG. 8 illustrates an exemplary head piece 800, in another embodiment without hinged flap 720. Head piece 800 is an example of head piece 204 of FIG. 2. Particularly, referring to FIG. 1, head piece 800 is adapted for installation at the head 112. Head piece 800 includes flange 802, head return 804, and optional head back-dam 808. Flange 802, head return 804, and head back-dam 808 are similar to flange 702, return 704, and back-dam 708, respectively, as discussed above with respect to FIG. 7. For example, head return 804 is orthogonal to flange 802. Optional head back-dam 808 is orthogonal to head return 804. Head back-dam 808 is in a plane that is substantially parallel to the plane of flange 802. The rear surfaces of head piece 800 may include an adhesive such that head piece 800 may be adhered in place to the exterior surface of structure 102 and/or the head 112.

Head piece 800 is further shown with optional head drip margin 822 at the intersection of head return 804 to flange 802. It should be appreciated that head piece 700 may include a drip margin similar to head drip margin 822 shown in FIG. 8.

Figure 9:
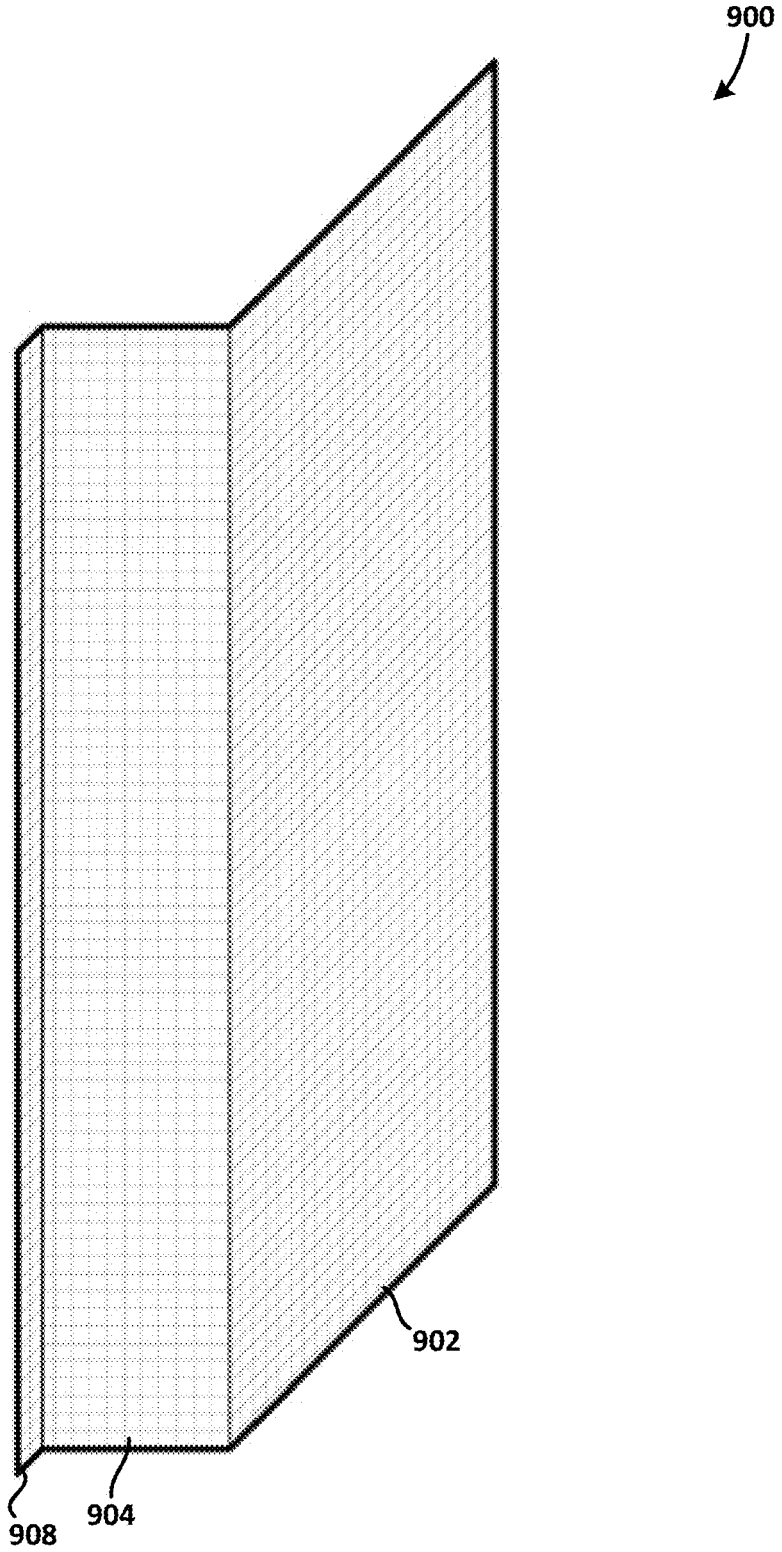
FIG. 9 illustrates an exemplary jamb piece, in one embodiment.

FIG. 9 illustrates an exemplary jamb piece 900, in one embodiment. Jamb piece 900 is an example of jamb piece 206 of FIG. 2. Particularly, referring to FIG. 1, jamb piece 900 is adapted for installation at the right vertical jamb 110(2). Jamb piece 900 includes flange 902, jamb return 904, and optional jamb back-dam 908. Flange 902, jamb return 904, and jamb back-dam 908 are similar to flange 402, jamb return 406, and jamb back-dam 410, respectively, as discussed above with respect to FIG. 4. For example, jamb return 904 is orthogonal to flange 902. Optional jamb back-dam 908 is orthogonal to jamb return 904. Jamb back-dam 908 is thereby in a plane that is substantially parallel to the plane of flange 902. The rear surfaces of jamb piece 900 may include an adhesive such that jamb piece 900 may be adhered in place to the exterior surface of structure 102 and/or the jamb 110. It should also be appreciated that, although not shown, jamb piece 900 may further include a jamb drip margin, similar to drip margins 620, 622, and 822, discussed above. Features of jamb piece 900 may be mirrored for installation to the left jamb 110(1) of the fenestration opening.

Figure 10:
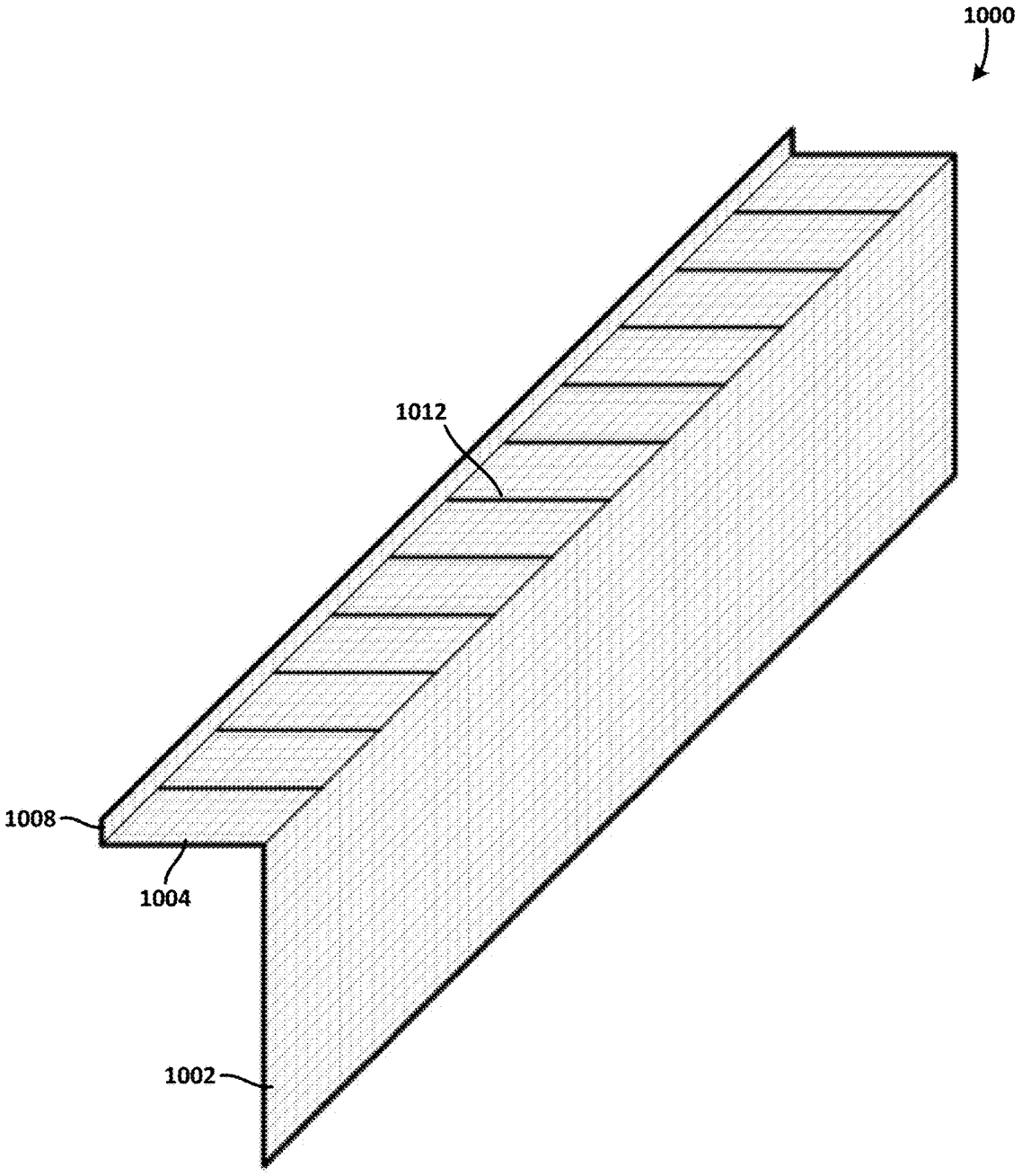
FIG. 10 illustrates an exemplary sill piece, in one embodiment.

FIG. 10 illustrates an exemplary sill piece 1000, in one embodiment. Sill piece 1000 is an example of sill piece 208 of FIG. 2. Particularly, referring to FIG. 1, sill piece 1000 is adapted for installation at the sill 108 of opening 106. Sill piece 1000 includes flange 1002, sill return 1004, and optional sill back-dam 1008. Sill return 1004 is orthogonal to flange 1002. Optional sill back-dam 1008 is orthogonal to sill return 1004. Sill back-dam 1008 is thereby in a plane that is substantially parallel to the plane of flange 1002. Sill piece 1000 further includes optional sill drainage ribs 1012 extending between the outer surface of sill piece 1000 and optional sill back-dam 1008. Drainage ribs 1012 are raised from the surface of sill return 1004 such that when the fenestration product is installed, the product is offset from the surface of sill return 1004 to allow for air or moisture drainage away from sill back-dam 1008. The rear surfaces of sill piece 1000 may include an adhesive such that sill piece 1000 may be adhered in place to the exterior surface of structure 102 and/or the jamb 110 and sill 108.

Although not illustrated, sill piece 1000 may additionally include a ramp element attached to the rear surface of the sill return 1004. The ramp element causes the slope of the sill piece 1000 to slope downwardly from the interior of the structure (such as from the return back-dam 1008) towards the flange 1002. The ramp element may be directly attached to the rear surface, or alternatively be a separate element that is attached to the sill 108, and that the sill return 1004 attaches to. In certain cases, an appropriate slope of ramp element is from zero (un-sloped) to about 0.25 inch per foot, but the slope may be more or less depending on the circumstances.

The illustrated shapes and configuration of the various pieces of scaffolding system 200 shown above in FIGS. 2-10 are not intended to be limiting in scope. In other words, the pieces of scaffolding system 200 may be of any three-dimensional shape desired. Accordingly, the three-dimensional prefabricated scaffolding system described herein can be adapted to a variety of common architectural approaches to define and frame features that penetrate an exterior surface of a structure. One such variation is a stepped frame in which an opening in the structure is of a given size at one point in the exterior surface, and expands stepwise to a slightly larger size at the exterior surface. The stepwise expansion of the opening may be in the horizontal or vertical directions or both.

Figure 11:
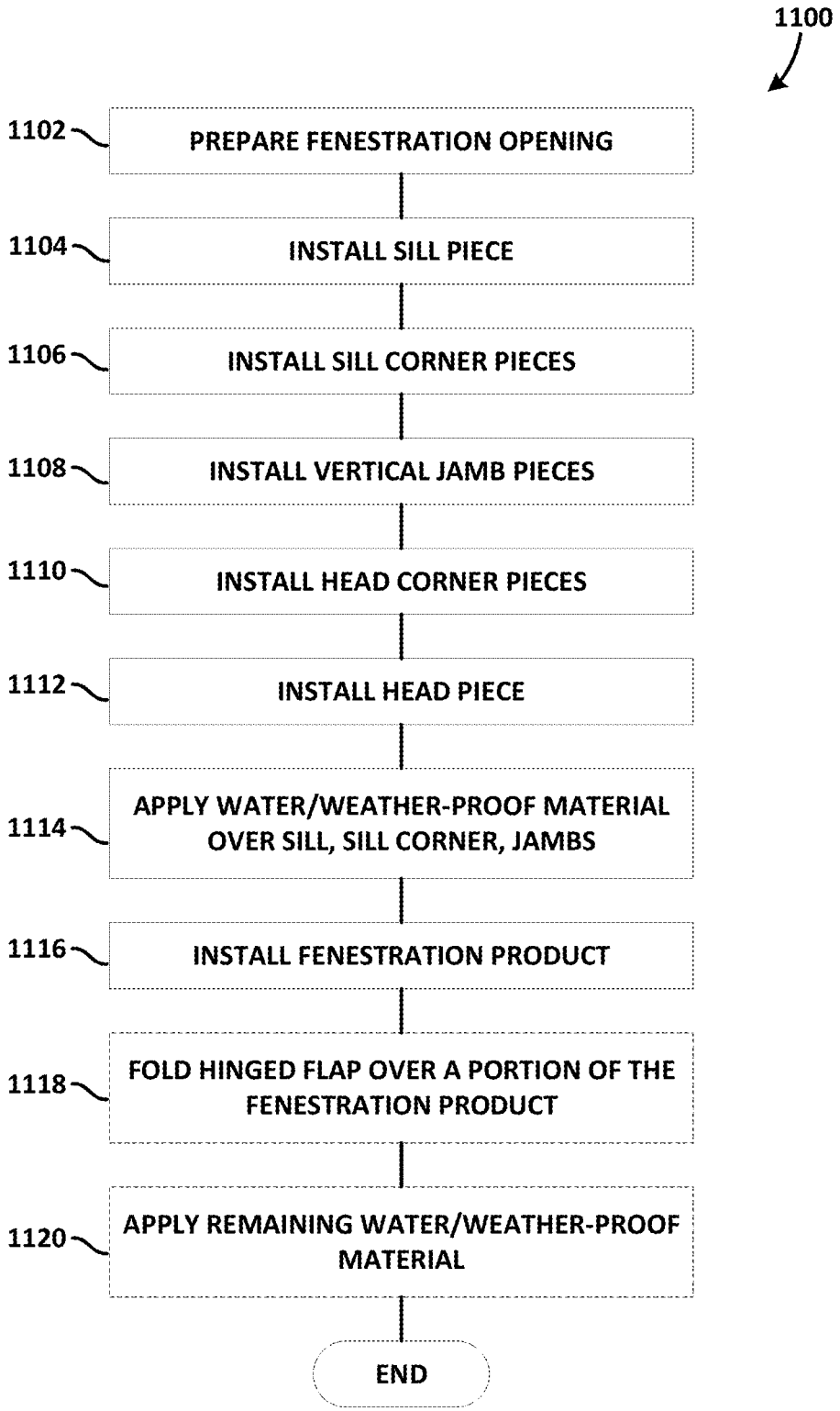
FIG. 11 shows an exemplary method for installing the scaffolding system of FIG. 2, in one embodiment.

FIG. 11 shows an exemplary method 1100 for installing scaffolding system 200 of FIG. 2, in one embodiment. FIGS. 12-21 depict exemplary illustrations of each step within method 1100 of FIG. 11.

Figure 12:
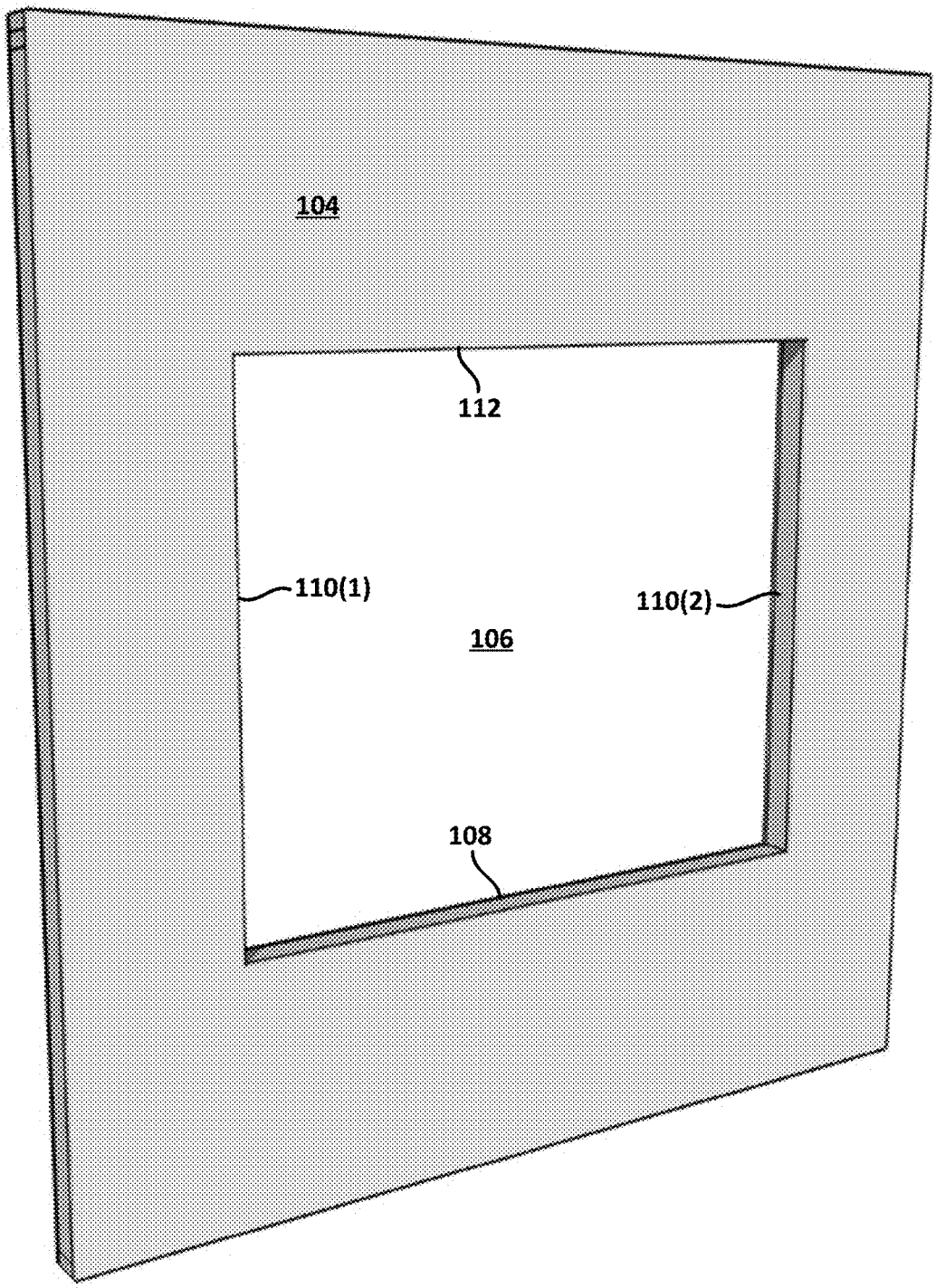
FIG. 12 illustrates an opening in a structure that will receive a fenestration product.

In step 1102, the fenestration opening is prepared. For example, as shown in FIG. 12, the fenestration opening 106, within structure 102 having exterior surface 104, includes sill 108, two vertical jambs 110(1), 110(2), and head 112, and is shaped and sized to receive a fenestration product. It should be appreciated that opening 106 may be of a different shape than illustrated in FIG. 12. Furthermore, although FIG. 12 illustrates a fenestration opening for a window, the fenestration for an opening may not include a sill 108.

Figure 13:
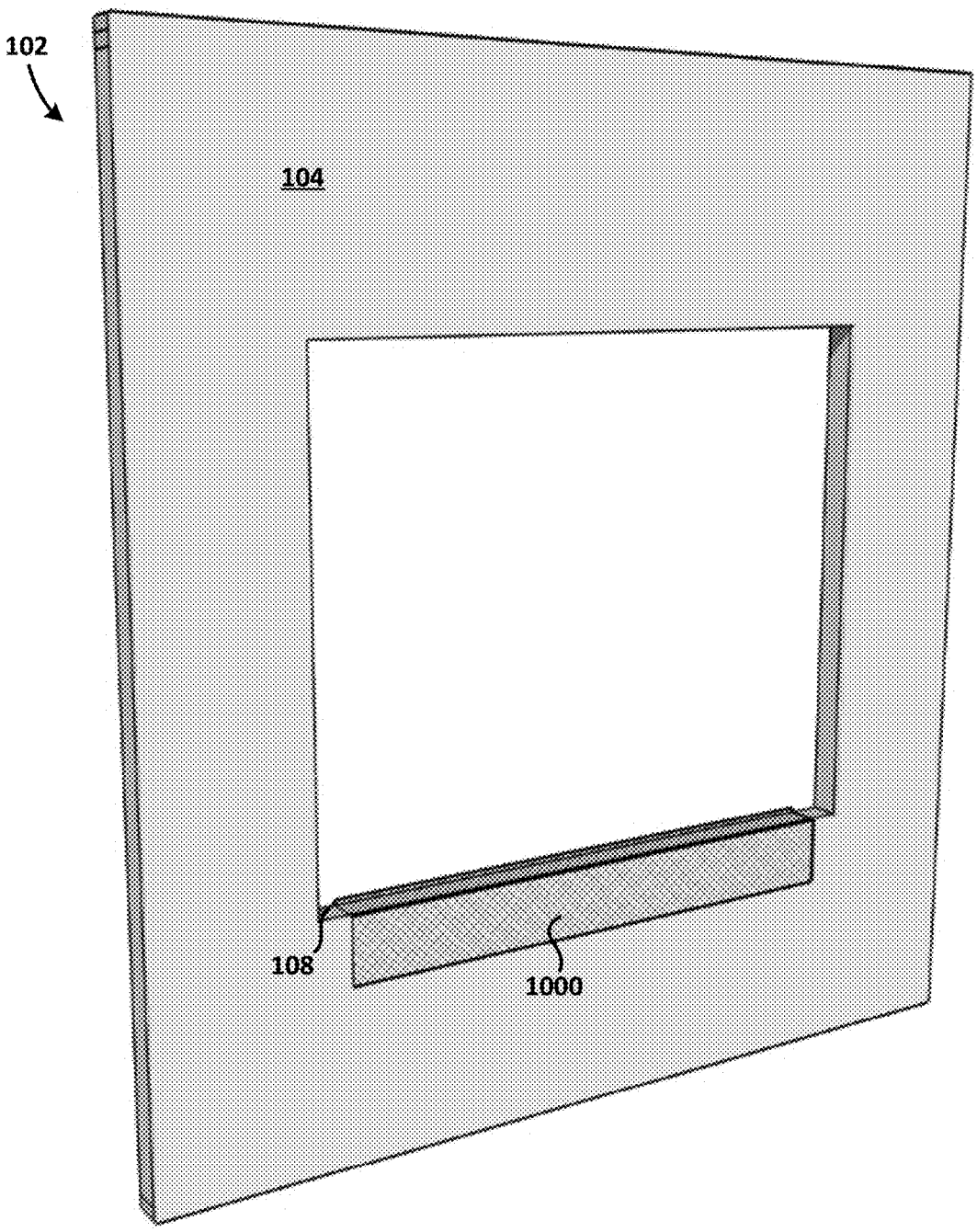
FIG. 13 illustrates the sill piece of FIG. 10, is installed on the sill of the opening for a window of FIG. 12.

In step 1104, the sill piece of scaffolding system 200 is installed on sill 108 of FIG. 12. For example, as shown in FIG. 13, sill piece 1000, of FIG. 10, is installed on sill 108. If sill piece 1000 is backed with an adhesive, then during step 1104, sill piece 1000 is pressed against exterior surface 104 and sill 108. Alternatively, sill piece 1000 may be stapled, adhered, nailed, or otherwise attached to sill 108. In an example of step 1104, if sill 108 has a longer length than sill piece 1000, two sill pieces 1000, or a portion thereof, may be overlapped to obtain the desired length. Moreover, in certain cases, during step 1104, it may be desirable to slope the sill piece 1000 downwardly towards the flange of the sill piece 1000. Therefore, prior to installing the sill piece 1000, a ramp element may be attached to sill 108 having the desired slope. Sill piece 1000 is then adhered to the ramp element.). In certain cases, an appropriate slope is from zero (un-sloped) to about 0.25 inch per foot, but the slope may be more or less depending on the circumstances.

Figure 14:
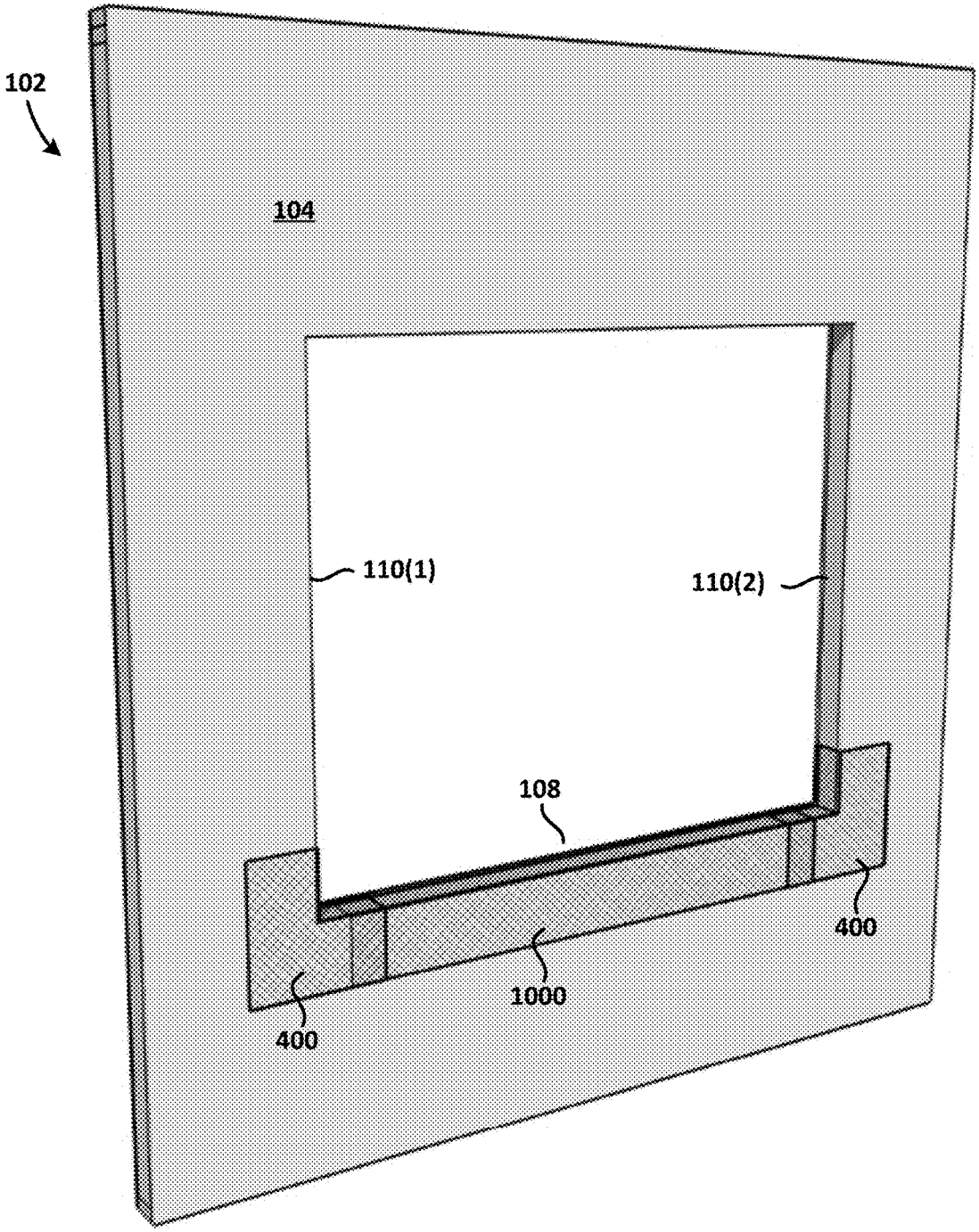
FIG. 14 illustrates the sill corner pieces of FIG. 4, is installed on the sill corners of the opening for a window of FIG. 13.

In step 1106, sill corner pieces of scaffolding system 200 are installed at the junction of the vertical jambs 110(1), 110(2), and sill 108. For example, as shown in FIG. 14, corner pieces 400 are installed to be overlapping sill piece 1000. If corner pieces 400 are backed with an adhesive, then during step 1106, each corner piece 400 is pressed against exterior surface 104, sill 108, and jamb 110(1), 110(2). Alternatively, each corner piece 400 may be stapled or otherwise attached to exterior surface 104, sill 108, and/or jamb 110(1), 110(2) to remain in its location.

Figure 15:
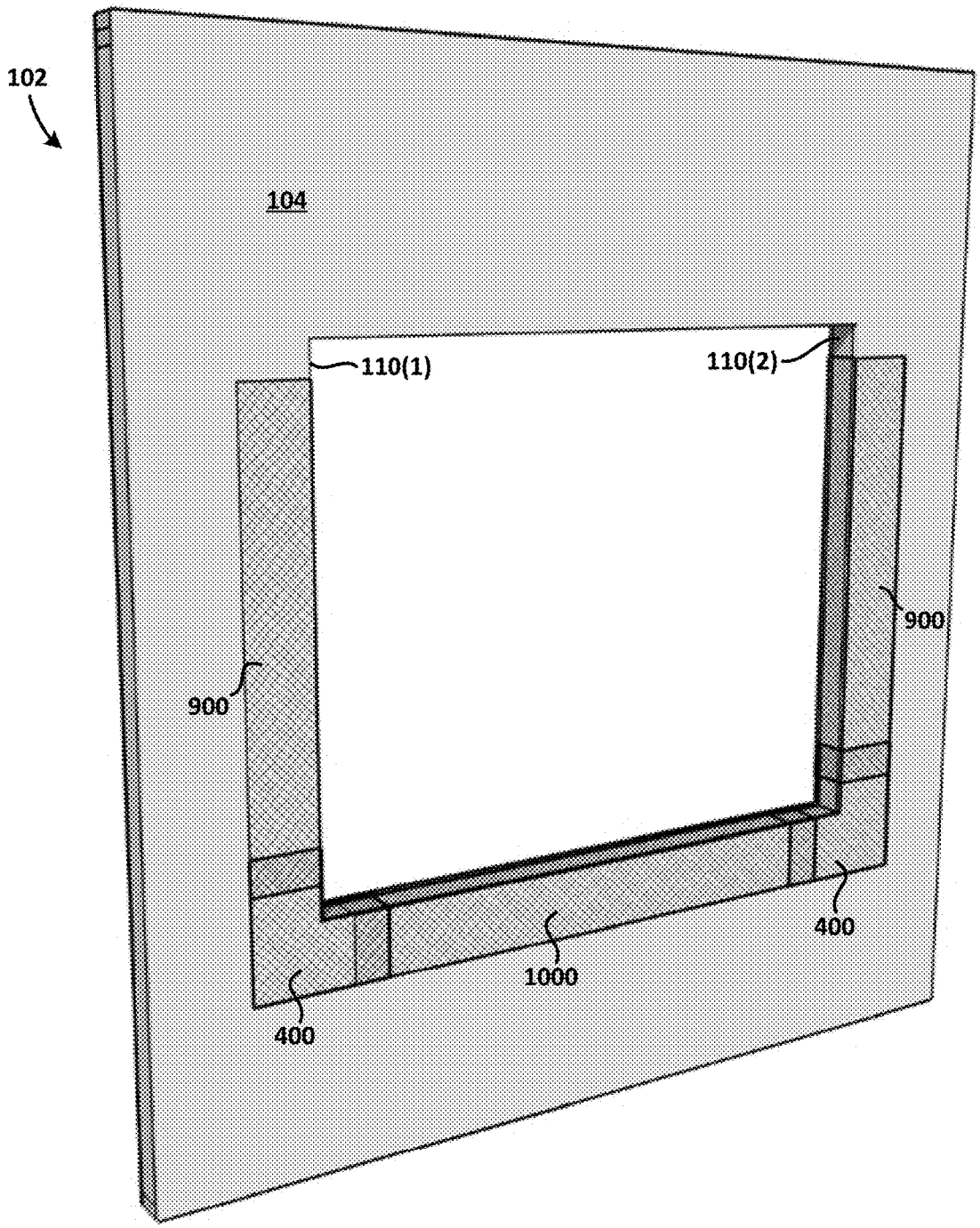
FIG. 15 illustrates the jamb pieces of FIG. 9, is installed on the jambs of the opening for a window of FIG. 14.

In step 1108, jamb pieces of scaffolding system 200 are installed at the along the height of the jamb. For example, as shown in FIG. 15, jamb pieces 900, of FIG. 9, are installed to be overlapping each respective corner piece 400. If jamb pieces 900 are backed with an adhesive, then during step 1108, each jamb piece 900 is pressed against exterior surface 104, and jamb 110(1), 110(2), respectively. Alternatively, each jamb piece 900 may be stapled or otherwise attached to exterior surface 104 and/or jamb 110(1), 110(2) to remain in its location. In an example of step 1108, if each jamb 110(1),110(2) has a longer length than jamb piece 900, two jamb pieces 900, or a portion thereof, may be overlapped to obtain the desired length.

Figure 16:
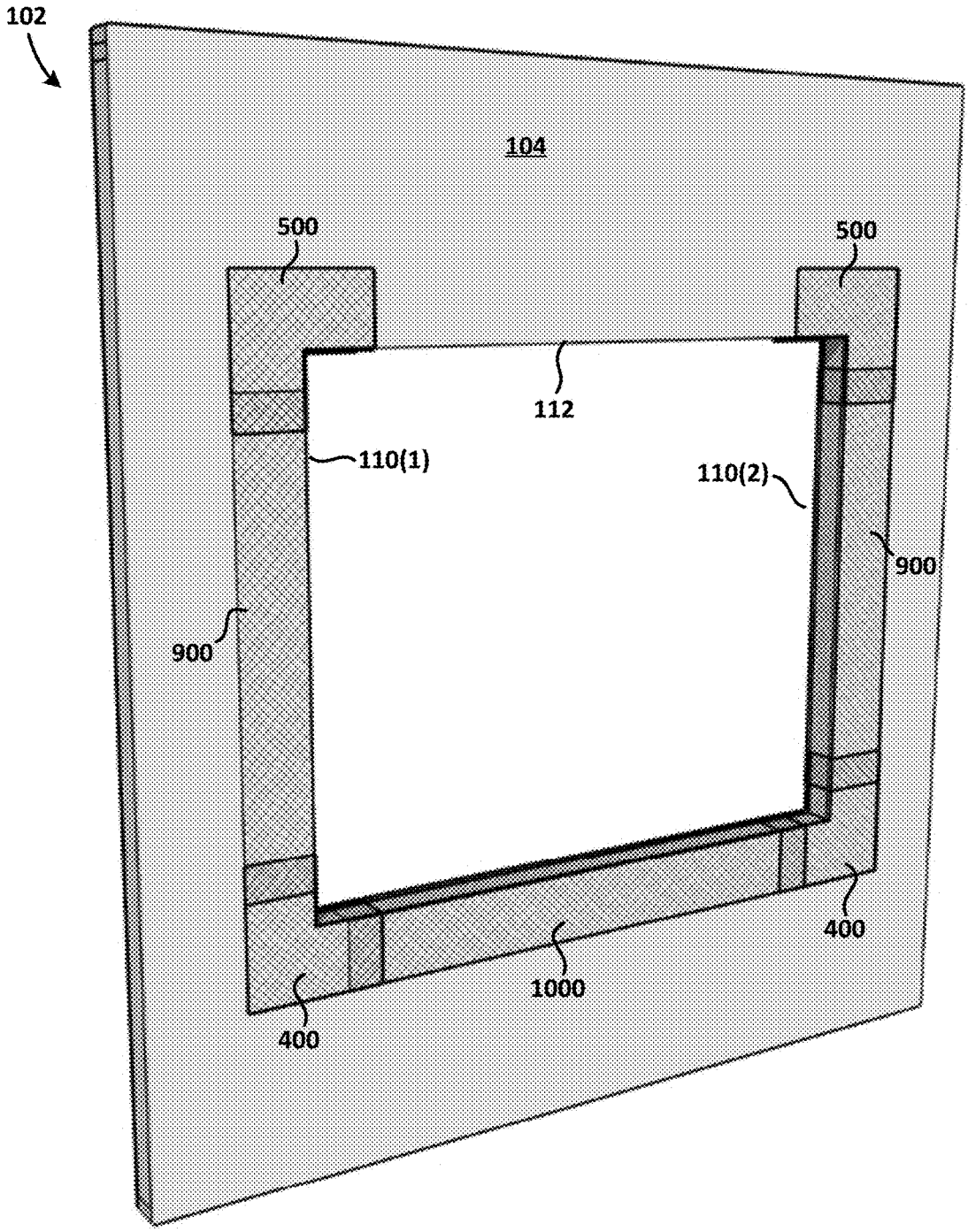
FIG. 16 illustrates the head corner pieces of FIG. 5, is installed on the head corners of the opening for a window of FIG. 15.

In step 1110, head corner pieces of scaffolding system 200 are installed at the junction of the vertical jambs 110(1), 110(2), and head 112. For example, as shown in FIG. 16, head corner pieces 500, of FIG. 5, are installed to be overlapping each respective jamb piece 900. If head corner pieces 500 are backed with an adhesive, then during step 1110, each head corner piece 500 is pressed against exterior surface 104, head 112, and jamb 110(1), 110(2). Alternatively, each head corner piece 500 may be stapled or otherwise attached to exterior surface 104, head 112, and/or jamb 110(1), 110(2) to remain in its location.

Figure 17:
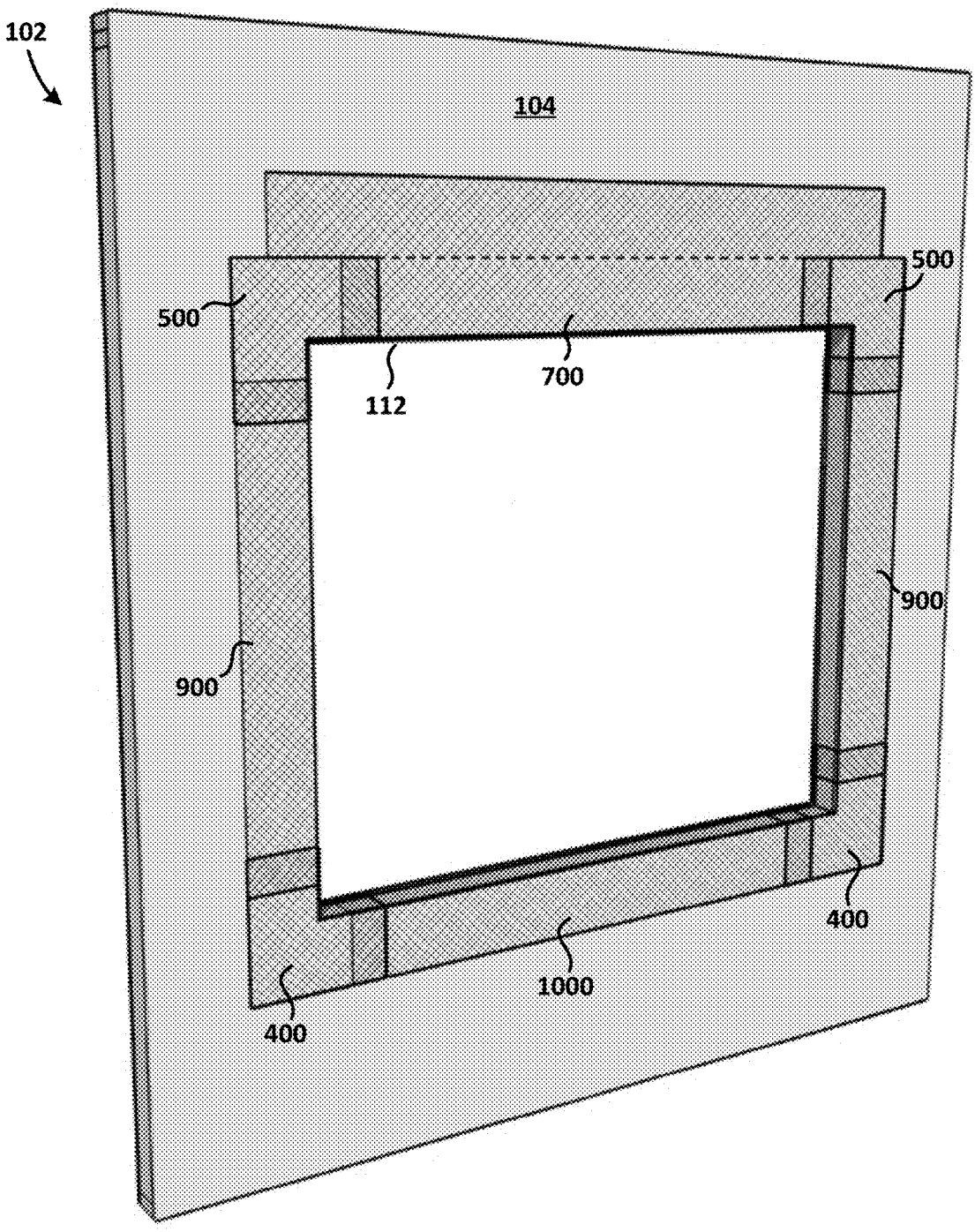
FIG. 17 illustrates the head piece of FIG. 7, is installed on the head of the opening for a window of FIG. 16.

In step 1112, the head piece of scaffolding system 200 is installed on head 112 of opening 106. For example, as shown in FIG. 17, head piece 700, of FIG. 7, is installed on head 112. If head piece 700 is backed with an adhesive, then during step 1112, head piece 700 is pressed against exterior surface 104 and head 112. Alternatively, head piece 700 may be stapled, adhered, nailed, or otherwise attached to head 112 and/or exterior surface 104. In an example of step 1112, if head 112 has a longer length than head piece 700, two head pieces 700, or a portion thereof, may be overlapped to obtain the desired length.

Figure 18:
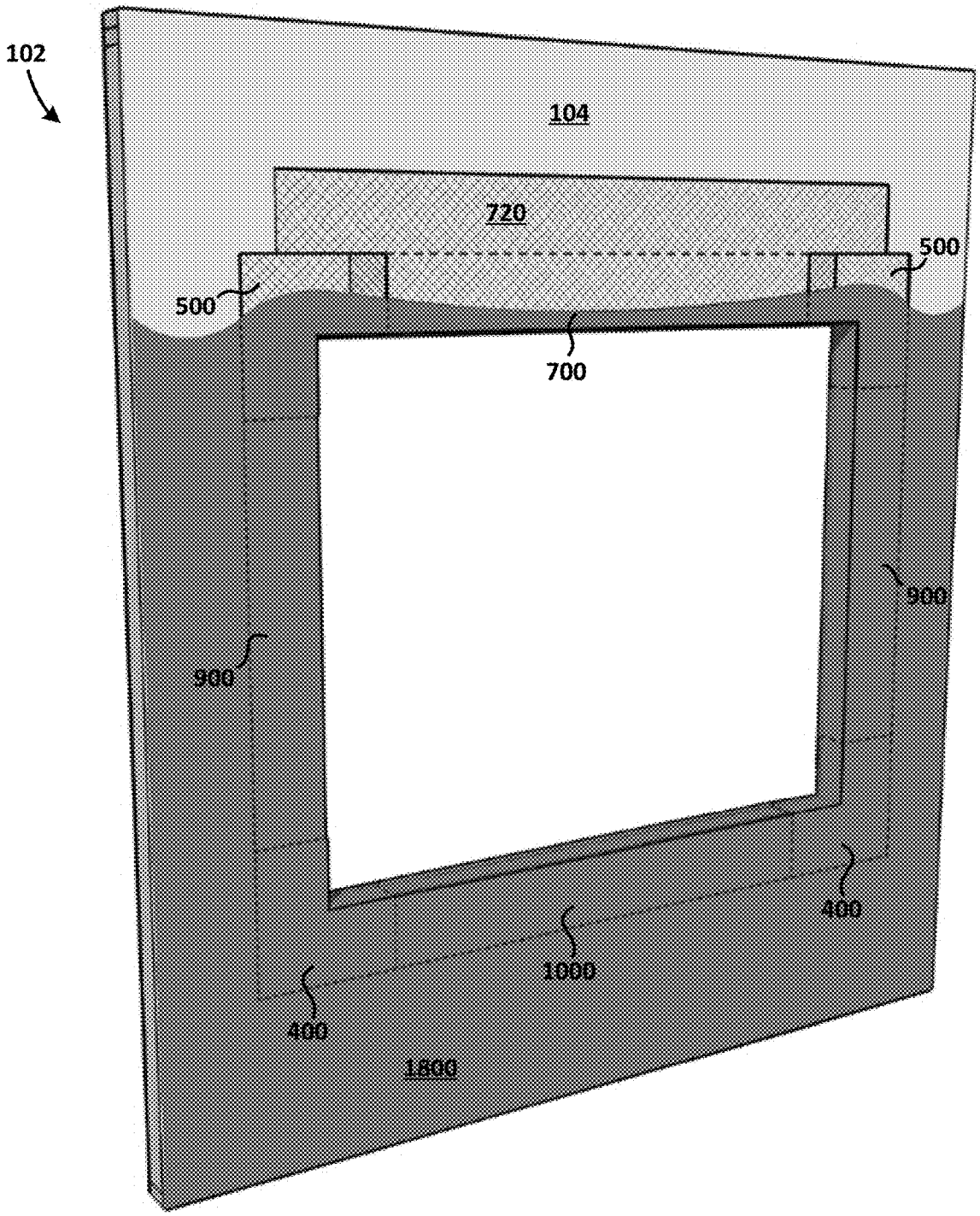
FIG. 18 illustrates fluid applied water/weather-proofing material applied on the scaffolding system installed on the opening for a window of FIG. 17.

In step 1114, a fluid water/weather-proofing material is applied (via spraying, rolling, brushing, or other fluid application method) over the portions of scaffolding system 200 installed in steps 1102-1112, above. Water/weather-proofing material may comprise any fluid applied material including one or more of asphalt, rubber, plastic, or other synthetic fluid water/weather-proofing material known in the art. As shown in FIG. 18, water/weather-proofing material 1800 may only be applied on a portion of the installed scaffolding system 200. For example, where head piece 700 includes hinged flap 720, the water/weather-proofing material 1800 is only applied on flange 704 of head piece 700. This allows hinged flap 720 to be folded over the nailing fin during installation of fenestration product in step 1116, discussed below. If, however, no additional manipulation of the scaffolding system is required to install the fenestration product, then the water/weather-proofing material 1800 may be applied over the entirety of the scaffolding system 200. Furthermore, as shown in FIG. 18, the water/weather-proofing material 1800 may be applied to a portion of, or the entirety of, exterior surface 104 of structure 102.

Figure 19:
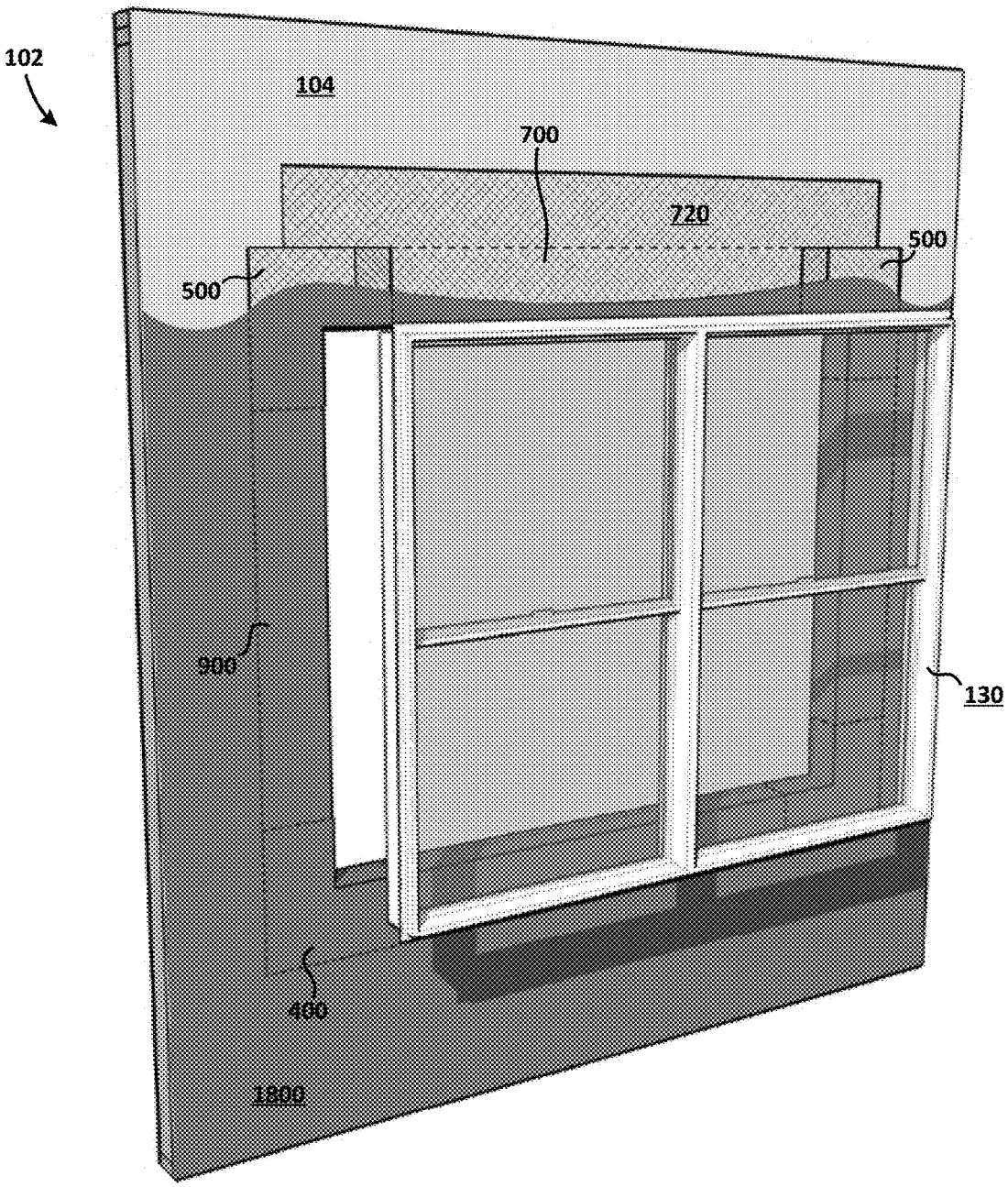
FIG. 19 illustrates a fenestration product being installed over the partially water/weather-proofed opening for a window of FIG. 18.
Figure 20:
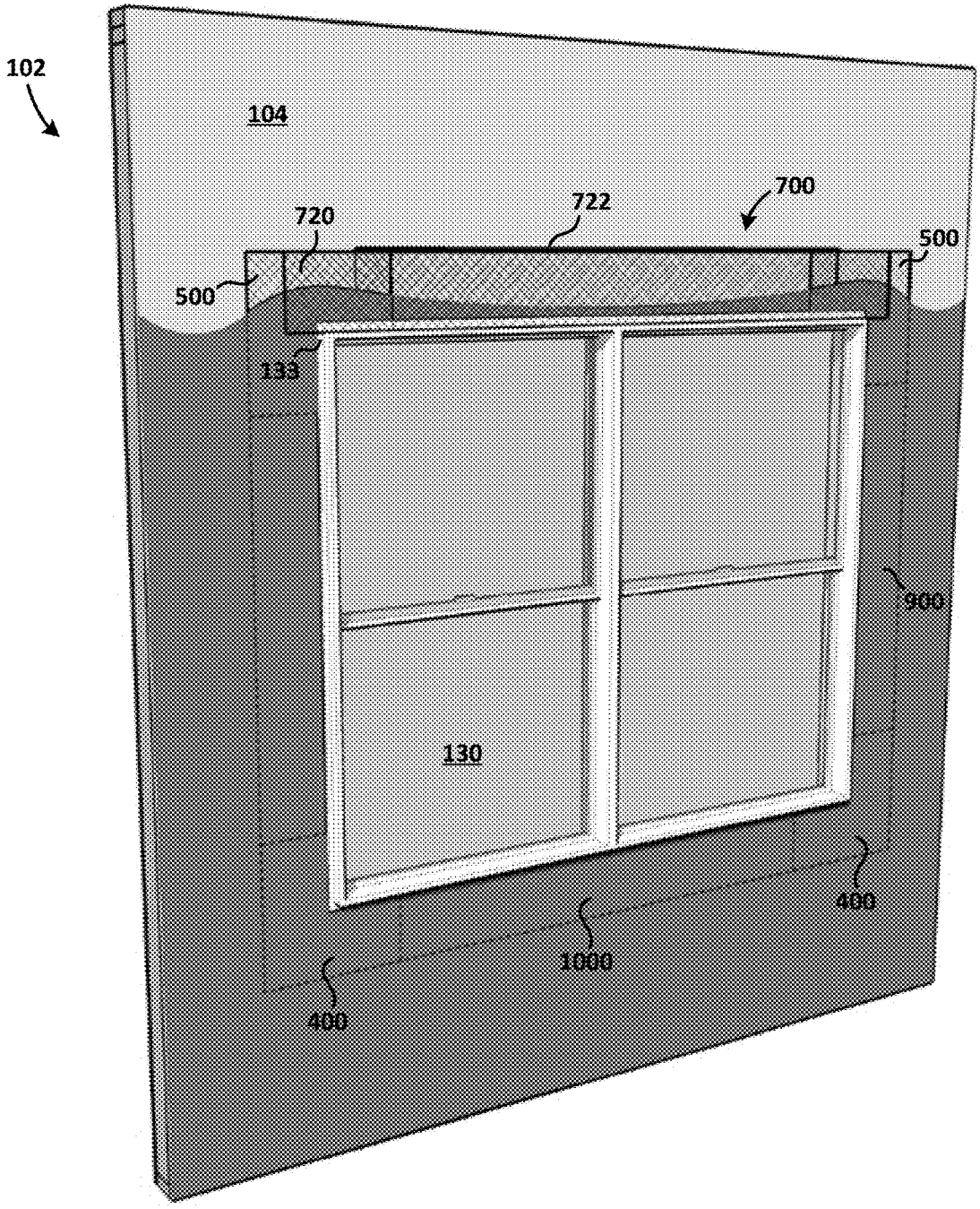
FIG. 20 illustrates a hinged flap of the head piece of FIGS. 17-19 folded over a nailing fin of the fenestration product of FIG. 19.

In step 1116, the fenestration product is installed. For example, as shown in FIG. 19, fenestration product 130, depicted as a window, is installed to fenestration opening such that the weatherproof material 1800 is between scaffolding system 200 and the fenestration product. In one example of step 1116, shown in FIG. 20, fenestration product 130 includes a nailing fin 132. Thus, during step 1116, hinged flap 720 of head piece 700 is folded over nailing fin 132. If hinged flap 720 includes adhesive on the exterior surface (discussed above with regards to FIG. 7), then the adhesive adheres to the exterior surface of nailing fin 132. To finish installation, nails or screws may be utilized to secure fenestration product in place within the fenestration opening.

In optional step 1118, a hinged flap is folded over a portion of the fenestration product. In one example of step 1118, hinged flap 720 at the top edge 702 of header piece 700 is folded over nailing fin 132 of window 130.

Figure 21:
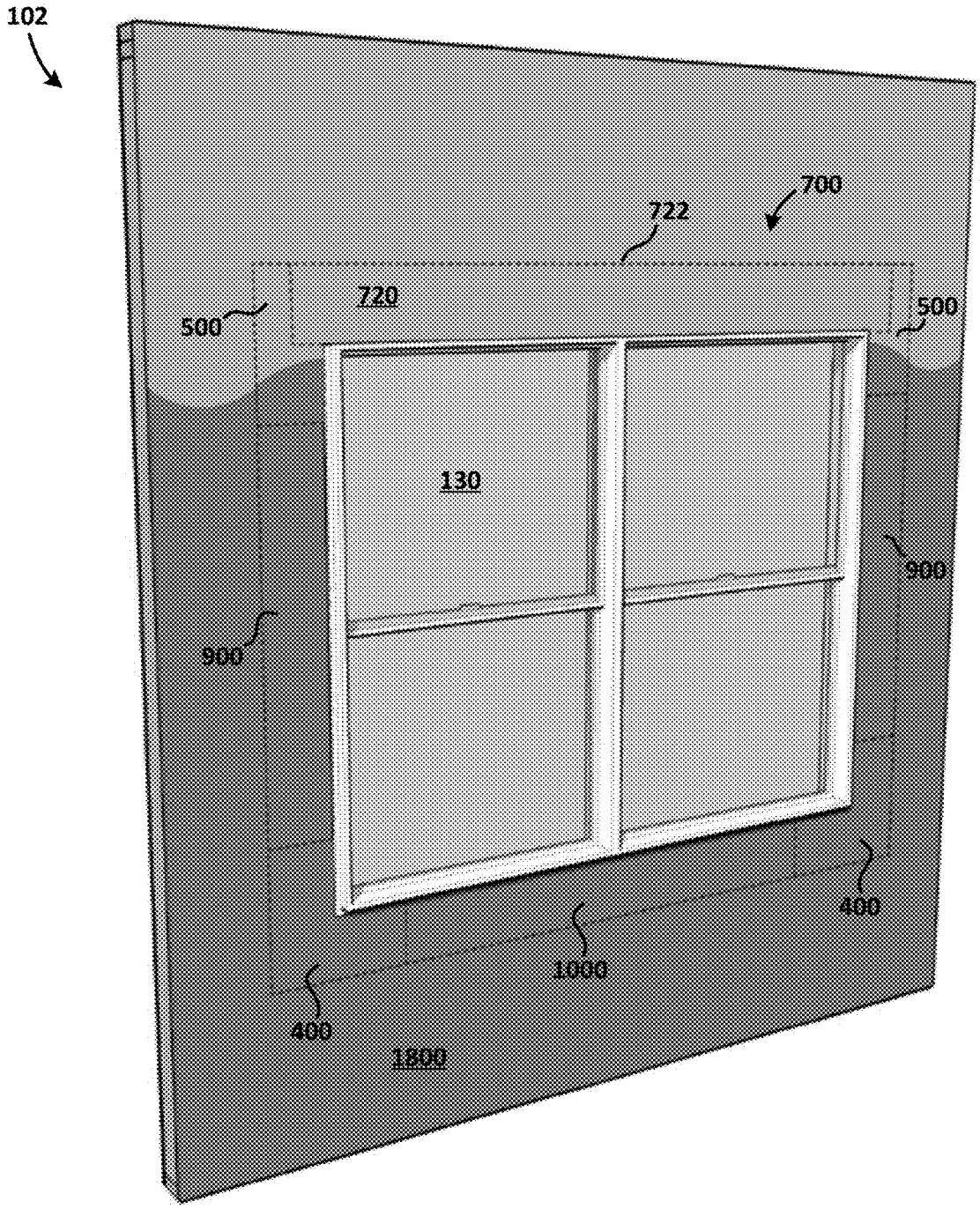
FIG. 21 illustrates fluid water/weather-proofing material applied on the remainder of scaffolding system installed on the opening for a fenestration product, in this case a window, of FIG. 21.

In step 1120, the remainder of the scaffolding system 200 is coated with water/weather-proofing material 1800. Step 11120 is optional where, in step 1114, the entirety of scaffolding system 200 (or exterior surface 104) is not previously coated with water/weather-proofing material 1800. As shown in FIG. 21, the remainder of scaffolding system 200 (and optionally exterior surface 104 of structure 102) is coated with the water/weather-proofing material 1800. Furthermore, although steps 1114-1120 illustrate fluid water/weather-proofing materials being applied over the entirety of surface 104 of structure 102, it should be appreciated that other types of water/weather-proofing material may be utilized to cover exterior surface 104. One example of this other type of water/weather-proofing material is a sheet weatherproof barrier. In such an example, the sheet may overlap, or be overlapped by the various pieces of scaffolding system 200 (such as being below or on top of the flanges of the scaffolding system 200). Then, the spray water/weather-proofing material is sprayed to cover both the scaffolding system 200, and the junction of the scaffolding system 200 to the sheet water/weather-proofing barrier.

It should be appreciated that the various steps of method 1100 could be completed in any order. For example, the various pieces of scaffolding system 200 could be overlapped in a different manner. Or, the pieces could not overlap at all, but placed next to each other. Moreover, after the fenestration product is installed, one or more types of exterior finishing products, such as siding, trim, and stucco product could be applied on top of spray water/weather-proofing material.

Figure 22:
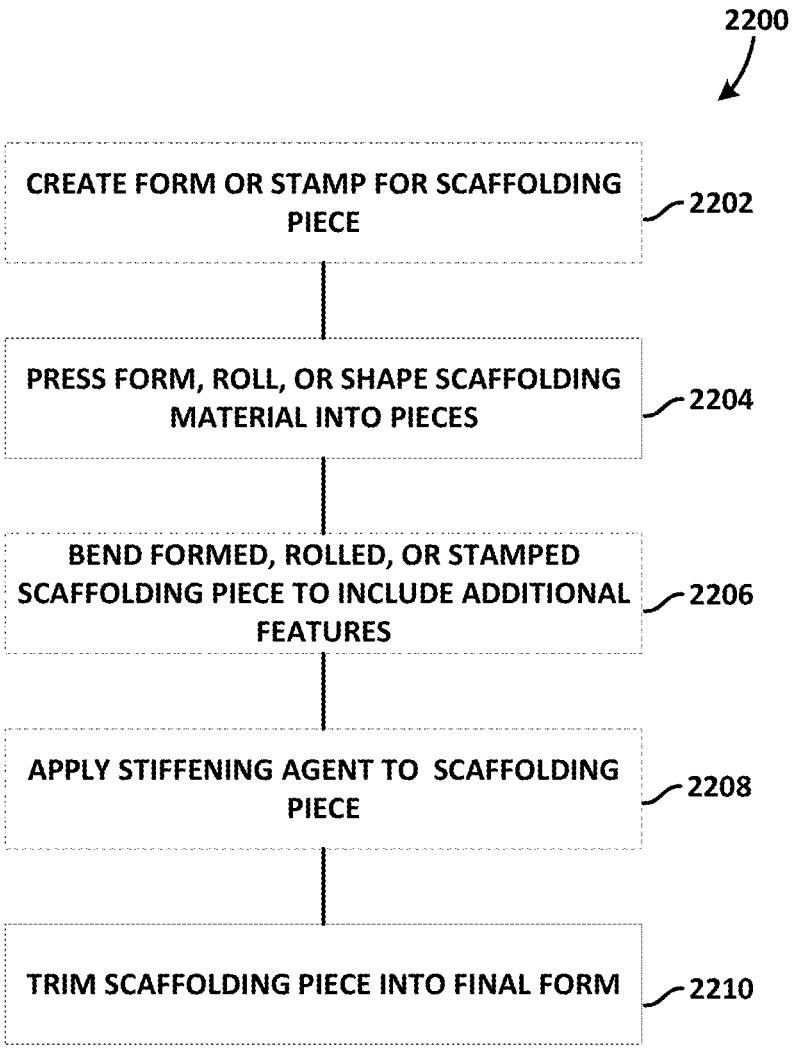
FIG. 22 shows an exemplary method for manufacturing a piece of the scaffolding system of FIG. 2, in one embodiment.

FIG. 22 depicts one exemplary method 2200 for manufacturing one or more pieces of scaffolding system 200. In step 2202, a form or stamp is created that corresponds to the desired shape of the scaffolding piece. For example, to create sill corner piece 400, of FIG. 4, the form or stamp may be created having features corresponding to flange 402, sill return 404, jamb return 406, optional sill back-dam 408, and optional jamb back-dam 410.

In step 2204, the scaffolding piece is created by pressing, rolling, forming or shaping scaffolding material into scaffolding pieces. For example, the form or stamp of step 2202 may be pressed into a mesh or semi-porous material. Such materials include, but are not limited to, fiberglass, plastic, rubber, metal, synthetics, or other formable material.

In optional step 2206, the stamped scaffolding piece is folded to include additional features. For example, in some circumstances, it may be more efficient to fold the back-dam features, or the drip margin features (disclosed above in FIGS. 2-10). Therefore, such features may be folded into the scaffolding system instead of being stamped.

In optional step 2208, a stiffening agent is applied to the scaffolding piece. The stiffening agent may be any material that will allow the stamped scaffolding piece to retain its shape with a predefined rigidity. The scaffolding piece does not need to be completely rigid, but instead may have a certain amount of flexibility. Optional step 2208 is not required where the scaffolding piece material is of sufficient rigidity by itself.

In optional step 2210, the scaffolding piece is trimmed into a final shape. For example, the stamping process of step 2204 may cause the scaffolding piece to have excess material at the edges. This excess material may be trimmed if desired.

The systems and methods disclosed herein provide significant advantages over prior flashing methods. The scaffold itself is not weatherproof or waterproof, but provides a three dimensional backing for the use of fluid applied or other weather/waterproofing material. Moreover, the predefined three-dimensional shape enables the installer to quickly and efficiently install the scaffolding system. The pre-manufactured corner shapes disclosed herein allow quick and easy placement to scaffold the corners of the opening. When combined with the other shapes herein, virtually any size and shape of window may be quickly and easily flashed.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A three-dimensional scaffolding for use in flashing a fenestration opening of a structure, comprising:

a flange;

a return connected to the flange;

the flange and return comprising a mesh or semi-porous material with sufficient rigidity to maintain a three-dimensional shape;

the scaffolding being non-waterproof prior to installation on a structure;

the scaffolding corresponding to a corner piece wherein:

the return comprises:

a sill/head return, for attaching to a sill/head of the opening, formed of the piece of mesh or semi-porous material, and a jamb return, for attaching to a jamb of the opening, formed of the piece of mesh or semi-porous material; and the flange connects to both the sill/head return and the jamb return.

2. The three-dimensional scaffolding of claim 1, further comprising an adhesive on an interior surface of at least one of the flange and the return, the interior surface corresponding to a surface that attaches to a surface of the fenestration opening or an exterior surface of the structure.

3. The three-dimensional scaffolding of claim 1, wherein:

the return defines a first plane, the flange defines a second plane that is orthogonal to the first plane.

4. The three-dimensional scaffolding of claim 1, further comprising a back-dam connected to the return and formed from the mesh or semi-porous material.

5. The three-dimensional scaffolding of claim 4, wherein:

the return defines a first plane, the flange defines a second plane that is orthogonal to the first plane, and the back-dam defines a third plane that is parallel and offset from the second plane.

6. The three-dimensional scaffolding of claim 4, further comprising a drip margin between the flange and the return.

7. The three-dimensional scaffolding of claim 1, the return comprising drainage ribs raised from an outer surface of the return.

8. The three-dimensional scaffolding of claim 1, the sill return comprising drainage ribs raised from an outer surface of the sill/head return.

9. The three-dimensional scaffolding of claim 1, wherein:

the sill/head return and jamb return define respective first and second planes that are orthogonal to each other, and the flange defines a third plane that is orthogonal to both the first and second planes.

10. The three-dimensional scaffolding of claim 1, further comprising:

a sill/head back-dam connected to the sill/head return and formed of the piece of mesh or semi-porous material, and a jamb back-dam connected to the jamb return and formed of the piece of mesh or semi-porous material.

11. The three-dimensional scaffolding of claim 10, the sill/head return comprising drainage ribs raised from an outer surface of the sill/head return.

12. The three-dimensional scaffolding of claim 10, wherein:

the sill/head return and jamb return define respective first and second planes that are orthogonal to each other, the flange defines a third plane that is orthogonal to both the first and second planes, and the sill back-dam and the jamb back-dam define a fourth plane that is parallel and offset from the third plane.

13. The three-dimensional scaffolding of claim 10, further comprising a drip margin between the return and the flange.

14. The three-dimensional scaffolding of claim 1, the flange and return being entirely formed from the mesh or semi-porous material.

15. A three-dimensional scaffolding for use in flashing a fenestration opening of a structure, comprising:

a flange;

a return connected to the flange;

the flange and return comprising a mesh or semi-porous material with sufficient rigidity to maintain a three-dimensional shape; and, a hinged flap connected to the flange at an edge of the flange opposite from the return;

the scaffolding being non-waterproof prior to installation on a structure.

16. The three-dimensional scaffolding of claim 15, the hinged flap having a greater length than the flange.

17. A three-dimensional scaffolding for use in flashing a fenestration opening of a structure, comprising:

a flange;

a return connected to the flange;

the flange and return comprising a mesh or semi-porous material with sufficient rigidity to maintain a three-dimensional shape;

the scaffolding being non-waterproof prior to installation on a structure;

a portion, but not all, the flange and return being formed from the mesh or semi-porous material.

* * * * *